US011414841B2

(12) United States Patent
Moriki et al.

(10) Patent No.: US 11,414,841 B2
(45) Date of Patent: Aug. 16, 2022

(54) CONSTRUCTION MACHINE

(71) Applicant: HITACHI CONSTRUCTION MACHINERY CO., LTD., Tokyo (JP)

(72) Inventors: Hidekazu Moriki, Tokyo (JP); Hisami Nakano, Tsuchiura (JP); Hiroshi Sakamoto, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 287 days.

(21) Appl. No.: 16/477,228

(22) PCT Filed: Dec. 5, 2017

(86) PCT No.: PCT/JP2017/043607
§ 371 (c)(1),
(2) Date: Jul. 11, 2019

(87) PCT Pub. No.: WO2018/179596
PCT Pub. Date: Oct. 4, 2018

(65) Prior Publication Data

US 2019/0360179 A1 Nov. 28, 2019

(30) Foreign Application Priority Data

Mar. 27, 2017 (JP) ..... JP2017-061427

(51) Int. Cl.
*E02F 9/26* (2006.01)
*E02F 3/43* (2006.01)

(52) U.S. Cl.
CPC ..... *E02F 9/265* (2013.01); *E02F 3/43* (2013.01); *E02F 3/435* (2013.01); *E02F 9/262* (2013.01)

(58) Field of Classification Search
CPC ..... E02F 9/265; G05D 1/0274
(Continued)

(56) References Cited

U.S. PATENT DOCUMENTS

2010/0223008 A1* 9/2010 Dunbabin ..... E02F 9/265 701/301
2013/0158787 A1 6/2013 Nomura et al.
(Continued)

FOREIGN PATENT DOCUMENTS

JP 60-212528 A 10/1985
JP 2011-137345 A 7/2011
(Continued)

OTHER PUBLICATIONS

Kunikata et al., Automatic Excavation Controller for Hydraulic Shovel English Translation, Oct. 24, 1985, Espacenet (Year: 1985).*
(Continued)

*Primary Examiner* — James M McPherson
*Assistant Examiner* — Kyle J Kingsland
(74) *Attorney, Agent, or Firm* — Mattingly & Malur, PC

(57) ABSTRACT

Provided are a work point position computing section configured to compute the relative position of a work point set on a bucket with respect to an upper swing structure on the basis of posture information, a target surface setting section configured to set a target surface as a target of excavation work on the basis of design surface information, a primary operation determining section configured to determine which of operations of a boom and an arm is a primary operation as a main operation when the work point is moved along the target surface, and a recommended operation computing section configured to compute a recommended operation amount and a recommended operation direction of a secondary operation as another operation different from the primary operation in the operations of the boom and the arm according to an operation amount and an operation direction of the primary operation.

5 Claims, 16 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2015/0376868 | A1* | 12/2015 | Jackson | E02F 9/2029 701/50 |
| 2016/0069040 | A1 | 3/2016 | Kami et al. | |
| 2016/0251835 | A1* | 9/2016 | Kitajima | E02F 3/32 701/50 |
| 2018/0305902 | A1* | 10/2018 | Tsukamoto | E02F 3/435 |

FOREIGN PATENT DOCUMENTS

| | | | |
|---|---|---|---|
| JP | 2016-205088 | A | 12/2016 |
| WO | 2012/114869 | A1 | 8/2012 |
| WO | 2015/025987 | A1 | 2/2015 |

OTHER PUBLICATIONS

International Preliminary Report on Patentability received in corresponding International Application No. PCT/JP2017/043607 dated Oct. 10, 2019.
International Search Report of PCT/JP2017/043607 dated Feb. 13, 2018.

* cited by examiner

CONSTRUCTION MACHINE

TECHNICAL FIELD

The present invention relates to a construction machine.

BACKGROUND ART

There is an operation assistance system that assists in operation of an operator in excavation work when an original landform is formed into a three-dimensional target shape by a construction machine (a hydraulic excavator, for example). Known as such an operation assistance system is, for example, an operation assistance system performing machine guidance that displays positional relation between a target shape and a work tool such as a bucket on a monitor in place of finishing stakes used in conventional construction or an operation assistance system performing machine control that semiautomatically controls the construction machine according to a deviation between the target shape and the position of the work tool.

In addition, Patent Document 1, for example, discloses a display system of a hydraulic excavator which display system displays, on a display unit, a guidance screen including an image representing positional relation between a design surface as a target shape and a cutting edge of a bucket as a work tool and information indicating a distance between a closest position of the bucket and the design surface with an objective of enabling excavation work to be performed accurately.

PRIOR ART DOCUMENT

Patent Document

Patent Document 1: International Publication WO 2012/114869

SUMMARY OF THE INVENTION

Problems to be Solved by the Invention

In work (so-called leveling work) of forming a landform sufficiently below an implement arm formed by a boom, an arm, a bucket, and the like of a hydraulic excavator into a horizontal target shape, for example, an operator adjusts excavation speed in a direction parallel with a design surface by operating the arm, and adjusts excavation height by operating the boom. In such a case, the operator can operate the boom appropriately by referring to the information indicating the distance between the closest position of the bucket and the design surface (which information will hereinafter be referred to as distance information), as taught by the foregoing conventional technology.

However, depending on the position of the design surface with respect to the implement arm, an appropriate operation by the operator may be difficult with only the distance information. Specifically, in a case where a steep wall surface is excavated as the target shape, for example, when the bucket is moved downward from above along the design surface, a moving direction (speed in the height direction of a target surface) necessary for the arm is reversed with the height of a boom pivot as a boundary. That is, the direction of operating the arm by the operator is also reversed. It is therefore difficult to perform an appropriate operation with only the distance information. In addition, when leveling work in a region higher than the implement arm is performed or excavation work is performed with a wall surface on a near side below as the target shape, the operation of the boom for adjusting excavation height greatly changes an excavation speed necessary for the arm. That is, the operator needs to deal with changes in the speed necessary for the arm which changes are caused by the operation of the boom, and also in this case, it is difficult to obtain a sufficient excavation accuracy with only the distance information.

The present invention has been made in view of the above. It is an object of the present invention to provide a construction machine that can notify the operator of an appropriate operation in an easy-to-understand manner.

Means for Solving the Problems

The present application includes a plurality of means for solving the above-described problems. To cite an example thereof, there is provided a construction machine including: an articulated front work implement formed by vertically rotatably coupling a boom, an arm, and a work tool to one another, and vertically rotatably supported by a machine body of the construction machine; operation devices configured to output operation signals for respectively operating the boom, the arm, and the work tool of the front work implement; a posture information sensor configured to detect posture information of each of the boom, the arm, and the work tool; and an information processing device configured to perform information processing on a basis of the posture information detected by the posture information sensor, design surface information as information on a target shape of an excavation object, and the operation signals from the operation devices. The information processing device includes a work point position computing section configured to compute a relative position of a work point set on the work tool with respect to the machine body on a basis of the posture information, a target surface setting section configured to set a target surface as a target of excavation work on a basis of the design surface information, a primary operation determining section configured to determine which of operations of the boom and the arm is a primary operation as a main operation when the work point is moved along the target surface, and a recommended operation computing section configured to compute a recommended operation amount and a recommended operation direction of a secondary operation as another operation different from the primary operation in the operations of the boom and the arm according to an operation amount and an operation direction of the primary operation, and display the recommended operation amount and the recommended operation direction of the secondary operation on an instructing device, when the excavation work is performed.

Advantage of the Invention

According to the present invention, it is possible to notify the operator of an appropriate operation in an easy-to-understand manner.

MODES FOR CARRYING OUT THE INVENTION

Embodiments of the present invention will hereinafter be described with reference to the drawings. It is to be noted that while in the present embodiments, description will be made by illustrating, as an example of a construction machine, a hydraulic excavator equipped with a bucket as a work tool at a front end of a front work implement, the present invention can also be applied to hydraulic excavators equipped with attachments other than buckets.

First Embodiment

A first embodiment of the present invention will be described with reference to FIGS. 1 to 8.

Figure 1:
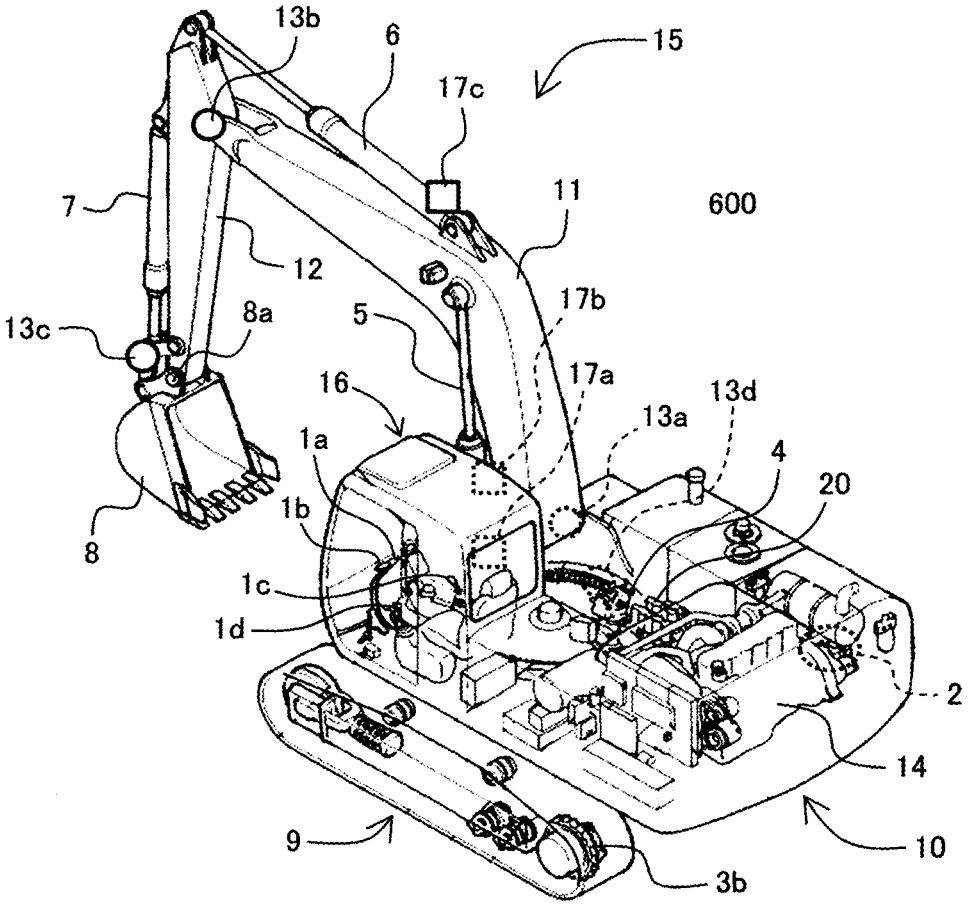
FIG. 1 is a diagram schematically depicting an external appearance of a hydraulic excavator as an example of a construction machine according to a first embodiment.

FIG. 1 is a diagram schematically depicting an external appearance of a hydraulic excavator as an example of a construction machine according to the present embodiment.

In FIG. 1, a hydraulic excavator 600 includes: a articulated implement arm (front work implement) 15 formed by coupling a plurality of driven members (a boom 11, an arm 12, and a bucket (work tool) 8) each rotated in a vertical direction to each other; and an upper swing structure 10 and a lower track structure 9 constituting a machine body. The upper swing structure 10 is provided swingably with respect to the lower track structure 9. In addition, a base end of the boom 11 of the implement arm 15 is supported so as to be rotatable in the vertical direction by a front portion of the upper swing structure 10. One end of the arm 12 is supported so as to be rotatable in the vertical direction by an end portion (front end) of the boom 11 which end portion is different from the base end. The bucket 8 is supported so as to be rotatable in the vertical direction by another end of the arm 12 via a bucket link 8*a*. The boom 11, the arm 12, the bucket 8, the upper swing structure 10, and the lower track structure 9 are respectively driven by a boom cylinder 5, an arm cylinder 6, a bucket cylinder 7, a swing hydraulic motor 4, and left and right travelling hydraulic motors 3*b* (only one travelling hydraulic motor is depicted) as hydraulic actuators.

The boom 11, the arm 12, and the bucket 8 operate in a plane including the implement arm 15. In the following, this plane may be referred to as an operating plane. That is, the operating plane is a plane orthogonal to rotation axes of the boom 11, the arm 12, and the bucket 8, and can be set at centers in a width direction of the boom 11, the arm 12, and the bucket 8.

An operation room 16 that an operator boards is provided with: a right operation lever device 1*c* and a left operation lever device 1*d* as operation levers (operation devices) that output operation signals for operating the hydraulic actuators 5 to 7 of the implement arm 15 and the swing hydraulic motor 4 of the upper swing structure 10; and a travelling right operation lever device 1*a* and a travelling left operation lever device 1*b* that output operation signals for operating the left and right travelling hydraulic motors 3*b* of the lower track structure 9.

The operation lever devices 1*c* and 1*d* are each tiltable in a forward-rearward direction and a left-right direction. The operation lever devices 1*c* and 1*d* each include a sensor not depicted in the figure which sensor electrically detects an amount of tilting of the lever as an operation signal, that is, a lever operation amount. The lever operation amounts detected by the sensors are output to an information processing device 100 (see FIG. 2) constituting a part of a controller via electric wiring. That is, operations of the hydraulic actuators 4 to 7 are each assigned to the front-rear direction or left-right direction of the operation lever devices 1*c* or 1*d*.

Operation control of the boom cylinder 5, the arm cylinder 6, the bucket cylinder 7, the swing hydraulic motor 4, and the left and right travelling hydraulic motors 3*b* is performed by controlling, through a control valve 20, the direction and flow rate of a hydraulic operating oil supplied to each of the hydraulic actuators 3*b* and 4 to 7 from a hydraulic pump device 2 driven by a prime mover such as an engine, an electric motor, or the like (an engine 14 in the present embodiment). The control valve 20 is performed by a driving signal (pilot pressure) output from a pilot pump not depicted in the figure via a solenoid proportional valve. The operation of each of the hydraulic actuators 3*b* and 4 to 7 is controlled by controlling the solenoid proportional valve by the controller on the basis of operation signals from the operation lever devices 1*c* and 1*d*. The boom 11 is rotated in an upward-downward direction with respect to the upper swing structure 10 by extension or contraction of the boom cylinder 5. The arm 12 is rotated in an upward-downward direction and a front-rear direction with respect to the boom 11 by extension or contraction of the arm cylinder 6. The bucket 8 is rotated in an upward-downward direction and a front-rear direction with respect to the arm 12 by extension or contraction of the bucket cylinder 7.

Incidentally, the operation lever devices 1*c* and 1*d* may be a hydraulic pilot type, and may be configured to drive each of the hydraulic actuators 3*b* and 4 to 7 by supplying pilot pressures corresponding to operation directions and operation amounts of the operation lever devices 1*c* and 1*d* each operated by the operator as driving signals to the control valve 20.

The boom cylinder 5 is provided with a boom bottom pressure sensor 17*a* that detects bottom side pressure of the boom cylinder 5 and a boom rod pressure sensor 17*b* that detects rod side pressure of the boom cylinder 5. In addition, the arm cylinder 6 is provided with an arm bottom pressure sensor 17*c* that detects bottom side pressure of the arm cylinder 6. Incidentally, while the present embodiment illustrates a case where the pressure sensors 17*a* to 17*c* are provided to the boom cylinder 5 and the arm cylinder 6, the pressure sensors may, for example, be provided to the control valve 20 or midpoints of piping that couples the control valve 20 to the respective hydraulic actuators 5 and 6.

Inertial measurement units (IMU: Inertial Measurement Units) 13*a* to 13*d* as posture sensors are respectively arranged in the vicinity of a part of the boom 11 which part is coupled to the upper swing structure 10, in the vicinity of a part of the arm 12 which part is coupled to the boom 11, on the bucket link 8*a*, and on the upper swing structure 10. The inertial measurement unit 13*a* is a boom posture sensor that detects the angle (boom angle) of the boom 11 with respect to a horizontal plane. The inertial measurement unit 13*b* is an arm posture sensor that detects the angle (arm angle) of the arm 12 with respect to the horizontal plane. The inertial measurement unit 13*c* is a bucket posture sensor that detects the angle of the bucket link 8*a* with respect to the horizontal plane. In addition, the inertial measurement unit 13*d* is a machine body posture sensor that detects the angle of inclination (roll angle and pitch angle) of the upper swing structure 10 with respect to the horizontal plane.

The inertial measurement units 13*a* to 13*d* measure angular speed and acceleration. When consideration is given to a case where the upper swing structure 10 and each of the driven members 8, 11, and 12 where the inertial measurement units 13*a* to 13*d* are arranged are stationary, the angles of the upper swing structure 10 and each of the driven members 8, 11, and 12 with respect to the horizontal plane can be detected on the basis of the direction of gravitational acceleration (that is, a vertically downward direction) in an IMU coordinate system set in each of the inertial measurement units 13*a* to 13*d* and states of attachment of the respective inertial measurement units 13*a* to 13*d* (that is, relative positional relations of the respective inertial measurement units 13*a* to 13*d* to the upper swing structure 10 and the driven members 8, 11, and 12). Here, the inertial measurement units 13*a* to 13*c* constitute a posture information sensor that detects posture information (angle signal) of each of the boom 11, the arm 12, and the bucket (work tool) 8.

Incidentally, the posture information detecting unit is not limited to the inertial measurement units, but inclination angle sensors, for example, may be used as the posture information detecting unit. In addition, potentiometers may be arranged on coupling parts of the respective driven members 8, 11, and 12, the relative orientations (posture information) of the upper swing structure 10 and the driven members 8, 11, and 12 may be detected, and the postures (angles with respect to the horizontal plane) of the respective driven members 8, 11, and 12 may be obtained from a result of the detection. In addition, stroke sensors may be arranged on the boom cylinder 5, the arm cylinder 6, and the bucket cylinder 7, respectively, the relative orientations (posture information) of the upper swing structure 10 and the driven members 8, 11, and 12 at respective connecting parts may be calculated from stroke change amounts, and the postures (angles with respect to the horizontal plane) of the respective driven members 8, 11, and 12 may be obtained from a result of the calculation.

Figure 2:
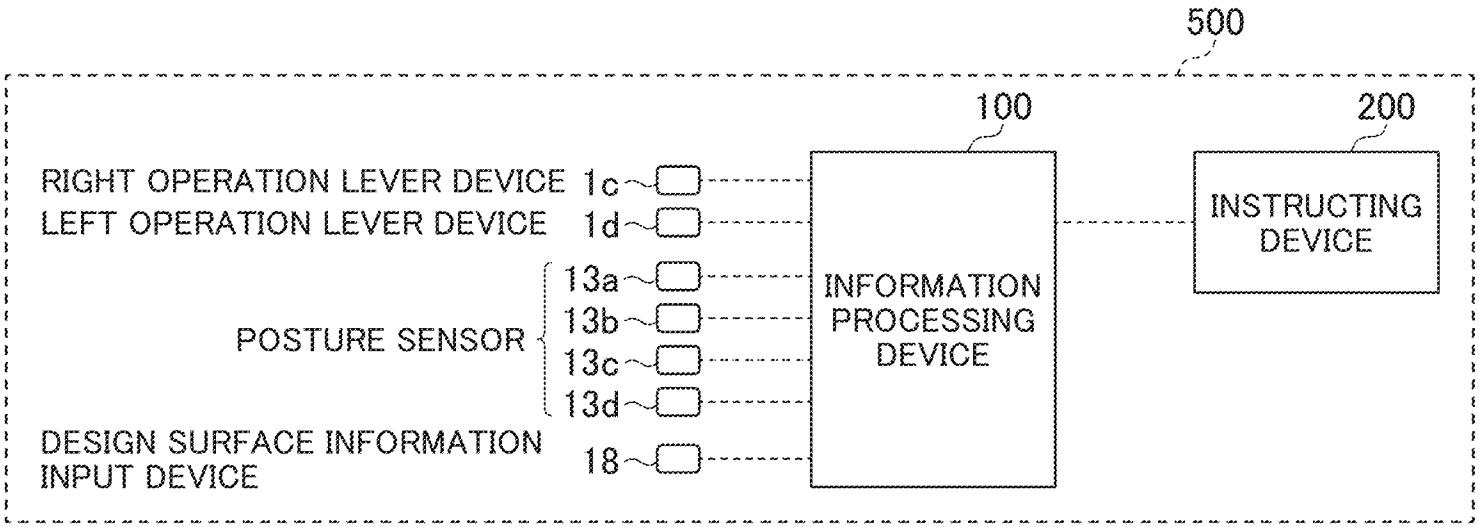
FIG. 2 is a diagram schematically depicting an operation assistance system incorporated in the hydraulic excavator.
Figure 3:
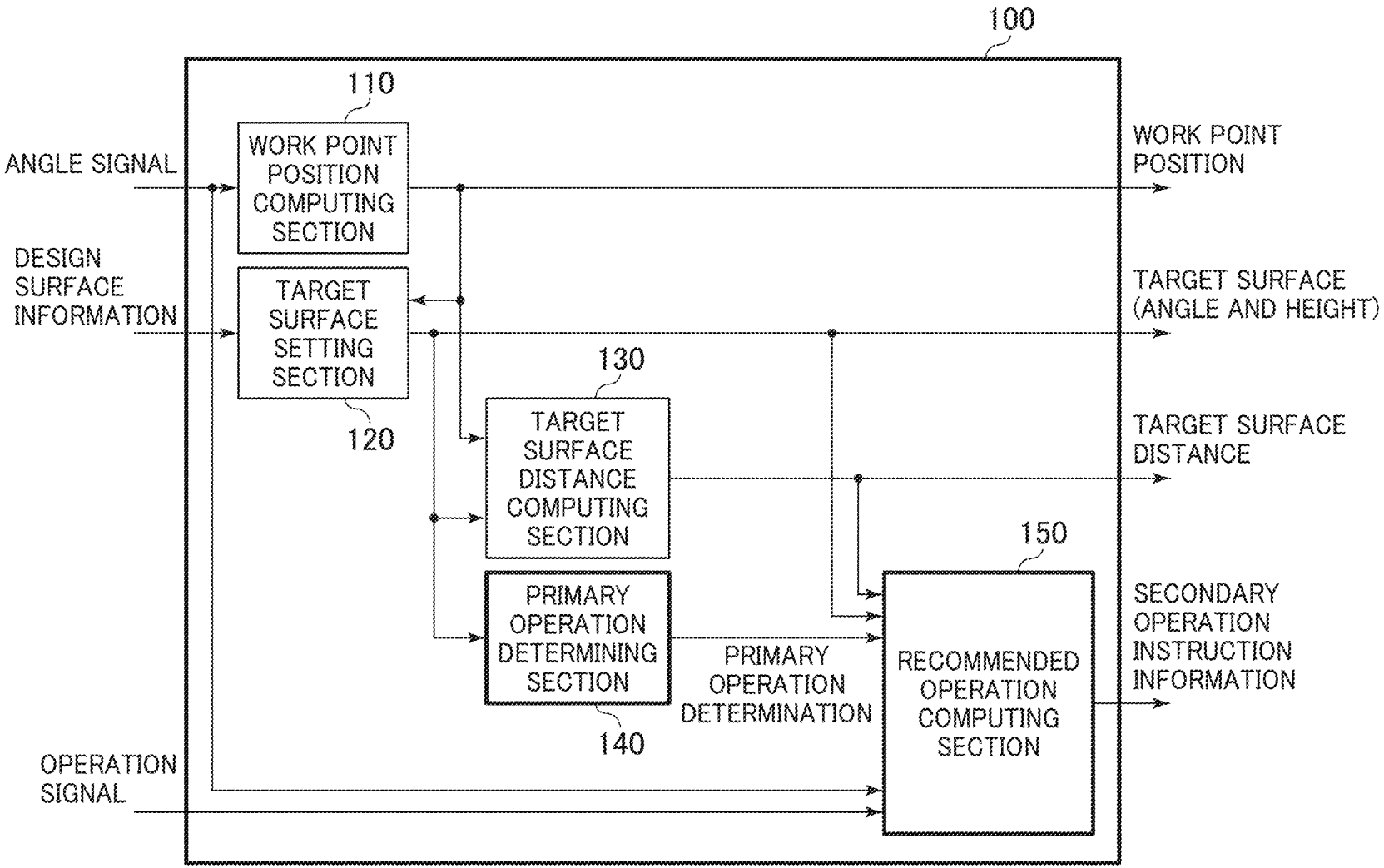
FIG. 3 is a functional block diagram depicting details of an information processing device.

FIG. 2 is a diagram schematically depicting an operation assistance system incorporated in the hydraulic excavator. FIG. 3 is a functional block diagram depicting details of the information processing device.

In FIG. 2, an operation assistance system 500 incorporated in the hydraulic excavator 600 includes: an information processing device 100 that constitutes one section of the controller that has various functions for controlling the operation of the hydraulic excavator 600 and generates information (assistance information) for assisting in excavation work of the operator; and an instructing device (display device) 200 such as a liquid crystal panel or the like that is disposed in the operation room 16 and instructs the operator about excavation work by the assistance information or the like. Operation signals from the left and right operation lever devices 1*c* and 1*d*, detection signals (angle signals: posture information) from the respective inertial measurement units 13*a* to 13*d*, and design surface information from a design surface information input device 18 are input to the information processing device 100. The information processing device 100 performs information processing on the basis of these inputs.

The design surface information input device 18 inputs the design surface information to the information processing device 100, the design surface information being information (target shape information) on a target shape of an excavation object, the target shape being set by a plurality of continuous target surfaces (line segments). The design surface information input device 18 is, for example, a storage device, and stores the target shape information computed using the positional information of the work machine and a three-dimensional working drawing obtained by defining a three-dimensional shape of the target shape (a slope shape, for example) of the excavation object by polygons.

Incidentally, the information processing device 100 is, for example, configured by using hardware including a CPU (Central Processing Unit) not depicted in the figure, a storage device such as a ROM (Read Only Memory), an HDD (Hard Disc Drive), or the like that stores various programs for performing processing by the CPU, and a RAM (Random Access Memory) serving as a work area when the CPU executes the programs.

In FIG. 3, the information processing device 100 has a work point position computing section 110, a target surface setting section 120, a target surface distance computing section 130, a primary operation determining section 140, and a recommended operation computing section 150.

The work point position computing section 110 computes the relative position of a work point set on the bucket (work tool) 8 with respect to the machine body (upper swing structure 10) on the basis of angle signals (posture information) from the inertial measurement units 13*a* to 13*d*. The work point position computing section 110 transmits the relative position of the work point as a work point position to the instructing device 200, and outputs the relative position of the work point as the work point position to the target surface setting section 120 and the target surface distance computing section 130. Here, suppose that the work point set on the bucket (work tool) 8 is, for example, the center of a claw tip of the bucket 8. Incidentally, used as a coordinate system indicating the work point position is a front implement coordinate system in which a center of rotation of the boom 11 is fixed as an origin O to the machine body, an x-axis is set in a forward direction of the upper swing structure 10, and a z-axis is set in an upward direction of the upper swing structure 10.

The target surface setting section 120 extracts a target surface as a work target from the design surface information input from the design surface information input device 18 on the basis of the work point position computed by the work point position computing section 110. The target surface setting section 120 transmits the target surface to the instructing device 200, and outputs the target surface to the target surface distance computing section 130 and the primary operation determining section 140. Incidentally, while various methods can be applied to the extraction of the target surface from the design surface information, a design surface present vertically below the work point, for example, may be set as the target surface. In addition, when the design surface is not present vertically below the work point, a design surface present in front or in the rear of the work point may be set as the target surface.

Figure 4:
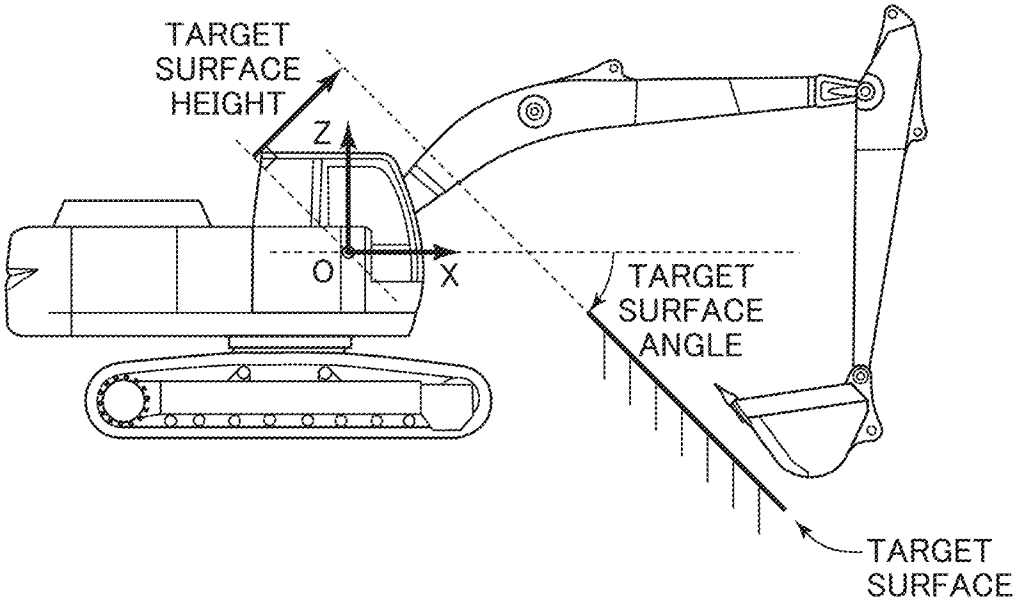
FIG. 4 is a side view schematically depicting positional relation between a target surface and a machine body.

FIG. 4 is a side view schematically depicting the positional relation between the target surface and the machine body. Incidentally, FIG. 4 does not depict the hydraulic actuators 5 to 7 for the simplicity of illustration.

As depicted in FIG. 4, in the front implement coordinate system, an inclination of the target surface set by the target surface setting section 120 with respect to the forward direction of the machine body, that is, an angle formed between the target surface and the x-axis is defined as a target surface angle. In addition, a perpendicular distance of the target surface from the center of rotation of the boom 11, that is, a distance between the target surface and the origin O of the front implement coordinate system is defined as a target surface height. When consideration is given to a target surface example parallel with the x-axis of the front implement coordinate system and set so as to face upward at a same height as the origin O, for example, the target surface angle and the target surface height are each 0 (zero). In addition, the target surface angle is positive in a case of a target surface having an inclination such that a machine body front side (x-axis positive side) thereof is lower than the target surface example. The target surface angle is negative in a case of a target surface having an inclination such that a machine body front side thereof is higher than the target surface example. In addition, the target surface height is positive in a case of a target surface present above the target surface example (that is, in a case where the origin O of the front implement coordinate system is not present on the top surface side of the target surface). The target surface height is negative in a case of a target surface present below the target surface example (that is, in a case where the origin O of the front implement coordinate system is present on the top surface side of the target surface).

The target surface distance computing section 130 computes a target surface distance as a distance from the target surface set by the target surface setting section 120 to the work point position computed by the work point position computing section 110. The target surface distance computing section 130 transmits the target surface distance to the instructing device 200, and outputs the target surface distance to the recommended operation computing section 150.

The primary operation determining section 140 determines which of operations of the boom 11 and the arm 12 is a primary operation as a main operation when the implement arm 15 performs excavation work on the target surface set by the target surface setting section 120. The primary operation determining section 140 determines the primary operation according to the target surface angle and the target surface height of the target surface set by the target surface setting section 120, and outputs the determination as a primary operation determination to the recommended operation computing section 150.

Here, the main operation (primary operation) in the excavation work refers to an operation corresponding to a driven member (the boom 11 or the arm 12 in the present embodiment) that performs a movement as a primary component in an operation direction when the implement arm 15 is operated. That is, when the excavation work is performed so as to move the work point along a certain target surface, a higher operating speed or a larger operation amount of the boom 11 or the arm 12 is determined as that of the primary operation. Whether the operation of the boom 11 corresponds to the primary operation or whether the operation of the arm 12 corresponds to the primary operation depends on the position and traveling direction of the work point. However, when the target surface (the target surface angle and the target surface height) is determined, the primary operation in the excavation work on the target surface is also uniquely determined.

For example, a first determining method computes, by using a publicly known geometric computation, an angle change amount of the boom 11 with respect to the machine body (upper swing structure 10) and an angle change amount of the arm 12 with respect to the boom 11 when the work point moves on the target surface, and determines that an operation for the larger angle change amount is the primary operation on the basis of comparison between these angle change amounts. In addition, a second determining method may compute a speed component in a horizontal direction of the work point with respect to a boom angular speed and a speed component in the horizontal direction of the work point with respect to an arm angular speed when the boom 11 and the arm 12 are rotation-driven in a state in which the work point is present on the target surface, and may determine that an operation for the larger moving speed is the primary operation on the basis of comparison between these speed components. Incidentally, though not illustrated in the figure, in the present embodiment, a case is illustrated in which control is performed so as not to change the posture of the bucket (work tool) 8 with respect to the target surface in excavation work on the basis of information such as the target surface information and the posture information or the like.

Figure 5:
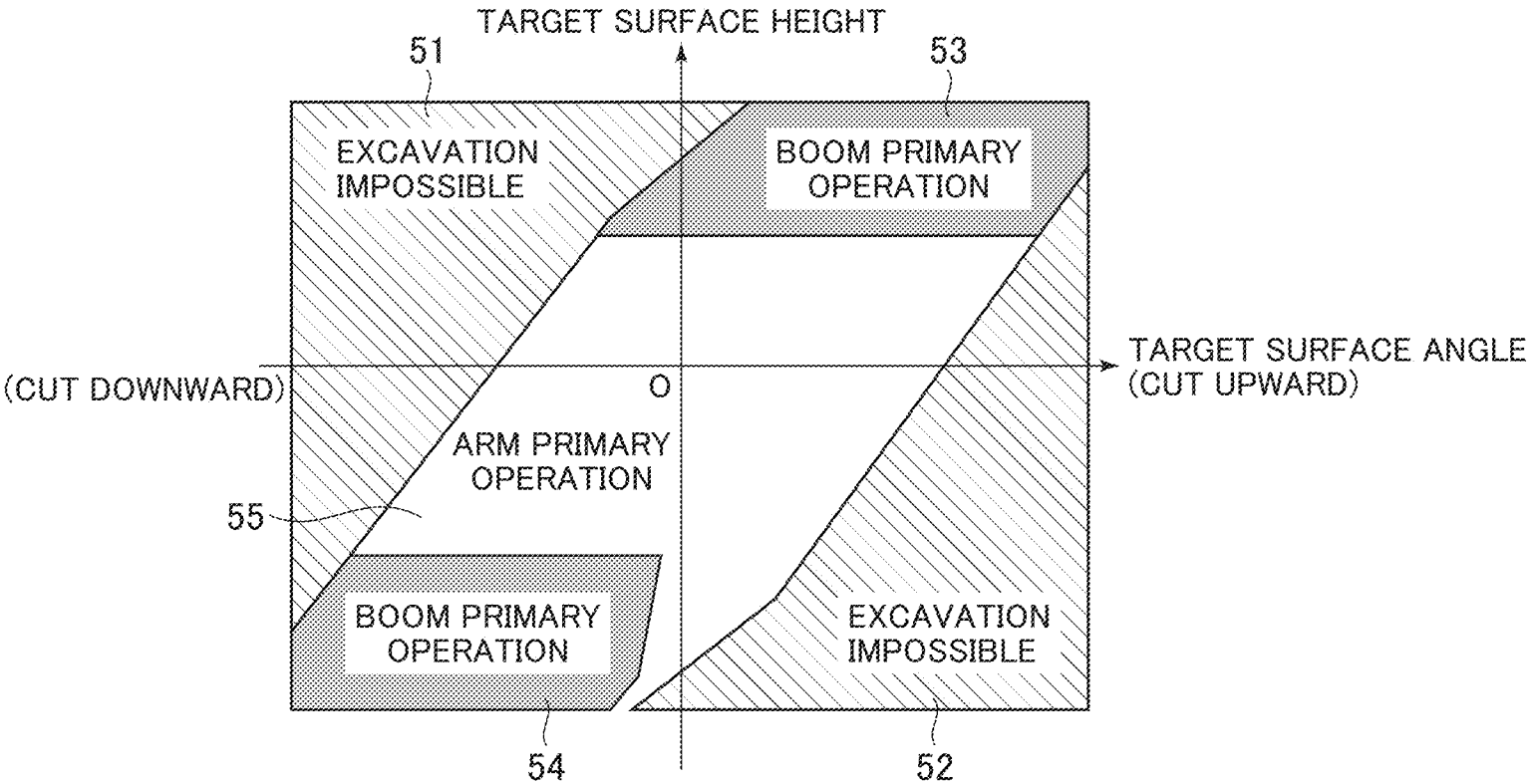
FIG. 5 is a diagram depicting determination results in a case where primary operation is determined while the target surface angle and the target surface height of the target surface are each changed.

FIG. 5 is a diagram depicting determination results in a case where the primary operation is determined while the target surface angle and the target surface height of the target surface are each changed.

In FIG. 5, the primary operation determination results have regions (excavation impossible regions) 51 and 52 that are positions that the work point does not geometrically reach and where excavation work is therefore not possible, a region (boom primary operation region) 53 where the angle change amount of the boom 11 is relatively large and therefore the operation of the boom 11 is determined as the primary operation, a region (boom primary operation region) 54 where the speed component in the horizontal direction of the work point which speed component corresponds to the arm angular speed is relatively small and therefore the operation of the boom 11 is determined as the primary operation, and another region (arm primary operation region 55) where the operation of the arm 12 is determined as the primary operation. Here, FIG. 5 can be said to be a primary operation determination table that receives the target surface angle and the target surface height of the target surface as input and provides a primary operation determination result (primary operation determination) as output.

Incidentally, while description has been made by illustrating the first and second determining methods in FIG. 5, the primary operation determination may be made by using another determining method. In addition, while in FIG. 5, results of determining the primary operation by using both of the first and second determining methods are combined into one determination result, the primary operation determination results (primary operation determination table) may be set by using only the second determining method, for example. In this case, determination results are obtained such that as compared with the primary operation determination results depicted in FIG. 5, the boom primary operation region 54 is eliminated and becomes an arm primary operation region. In addition, in a case where the primary operation determination results (primary operation determination table) are set by using only the first determining method, for example, determination results are obtained such that the range of the boom primary operation region 53 is reduced as compared with the primary operation determination results depicted in FIG. 5. In addition, the respective regions of the primary operation determination results (primary operation determination table) are geometrically determined from the structure and relative drivable range of members constituting the upper swing structure 10 and the implement arm 15, and are not necessarily symmetric with respect to the origin O of the target surface angle and the target surface height of the target surface or each coordinate axis passing through the origin O.

The recommended operation computing section 150 computes secondary operation instruction information as assistance information related to a secondary operation on the basis of the target surface (target surface angle) set by the target surface setting section 120, the target surface distance computed by the target surface distance computing section 130, the determination result (primary operation determination) of the primary operation determining section 140, and the operation signals from the operation lever devices (operation devices) 1*c* and 1*d*. The recommended operation computing section 150 outputs the secondary operation instruction information to the instructing device (display device) 200. The secondary operation instruction information includes information such as a recommended operation amount as a secondary operation recommended value of the secondary operation and a recommended operation direction, a present operation amount (including information on an operation direction), and the like.

Figure 6:
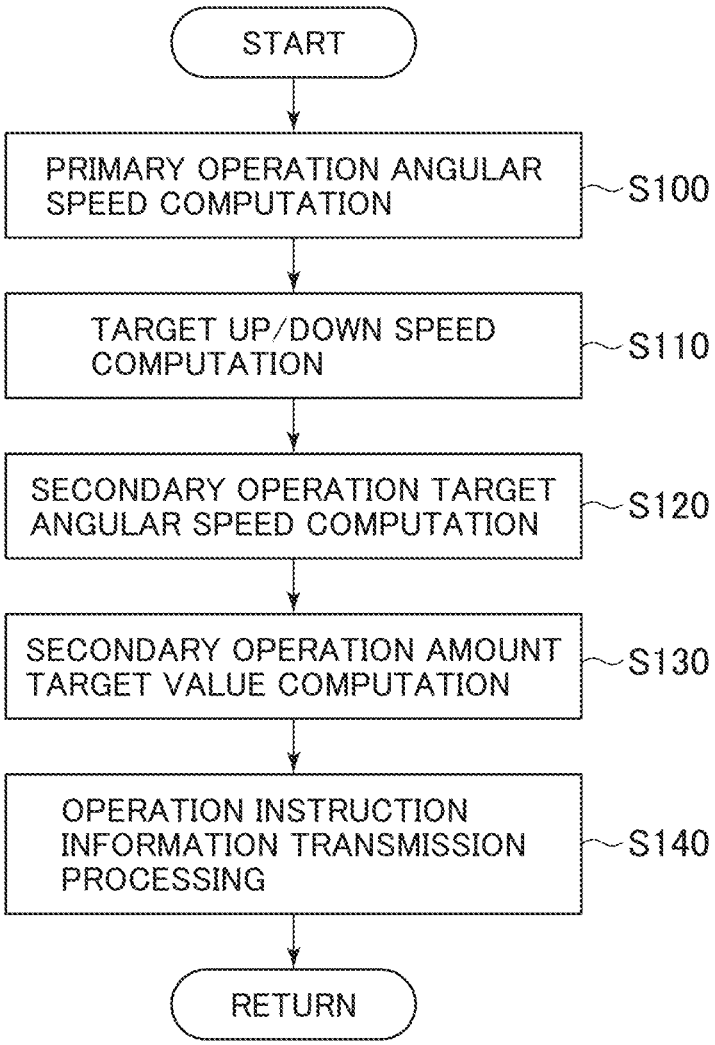
FIG. 6 is a flowchart depicting processing of computing secondary operation instruction information by a recommended operation computing section.

FIG. 6 is a flowchart depicting processing of computing the secondary operation instruction information by the recommended operation computing section.

In FIG. 6, on the basis of the operation signal for a driven member (the boom 11 or the arm 12) of the implement arm 15 which driven member is determined as the driven member in the primary operation, the recommended operation computing section 150 first computes the angular speed of the driven member in the primary operation (primary operation angular speed) (step S100). For example, when the boom 11 is the primary operation, the extension or contraction speed of the boom cylinder 5 is computed according to a boom operation signal, and the extension or contraction speed of the boom cylinder is converted into a boom angular speed on the basis of a boom angle signal. Similarly, also when the arm is the primary operation, the extension or contraction speed of the arm cylinder 6 is computed according to an arm operation signal, and the extension or contraction speed of the arm cylinder is converted into an arm angular speed on the basis of an arm angle signal. Incidentally, the primary operation angular speeds may be computed by differentiating the angle signals from the inertial measurement units 13*b* and 13*c* of the boom 11 and the arm 12.

Next, a target up/down speed as a target speed in a direction perpendicular to the target surface is computed on the basis of the target surface distance (step S110). When the target surface distance is positive, that is, when the work point is away from the target surface, the target up/down speed is set negative. When the target surface distance is negative, that is, when the work point has entered the target surface, the target up/down speed is set positive. The target up/down speed is thereby computed such that the work point moves along the target surface.

Next, a secondary operation target angular speed is computed according to the angle signal on the basis of the primary operation angular speed and the target up/down speed (step S120). When the operation of the boom 11 is the primary operation, for example, a target angular speed $\omega_{2t}$ of the arm 12 as the secondary operation is computed by using the following Equation (1).

[Math. 1]

$$\omega_{2t} = \dot{\theta}_{2t} = \frac{v_{zt} - a_{21}\omega_1}{a_{22}} \tag{1}$$

Here, $v_{zt}$ is the target up/down speed, and $\omega_1$ is the boom angular speed. In addition, $a_{21}$ and $a_{22}$ are components of a publicly known Jacobian matrix, are computed on the basis of the target angular speed and the angle signal, and are respectively coefficients when the perpendicular direction speed of the work point on the target surface according to the boom angular speed and the arm angular speed is computed.

In addition, similarly, when the operation of the arm 12 is the primary operation, a target angular speed $\omega_{1t}$ of the boom 11 as the secondary operation is computed by using the following Equation (2).

[Math. 2]

$$\omega_{1t} = \dot{\theta}_{1t} = \frac{v_{zt} - a_{22}\omega_2}{a_{21}} \quad (2)$$

Similarly, $v_{zt}$ is the target up/down speed, $\omega_2$ is the arm angular speed, and $a_{21}$ and $a_{22}$ are components of a publicly known Jacobian matrix.

Next, a secondary operation amount target value (recommended operation amount) as a recommended value of the secondary operation and a recommended operation direction are computed on the basis of the secondary operation target angular speed (step S130).

Next, secondary operation instruction information is generated on the basis of the primary operation determination, the operation signal, and the secondary operation amount target value, and is transmitted to the instructing device 200 (step S140). The secondary operation instruction information is operation instruction information for the secondary operation (the boom 11 or the arm 12). In the case where the boom 11 is the primary operation, the recommended operation amount and the recommended operation direction for the arm 12 in the secondary operation are transmitted as the secondary operation instruction information. In the case where the arm 12 is the primary operation, the recommended operation amount and the recommended operation direction for the boom 11 are transmitted as the secondary operation instruction information.

Figure 7:
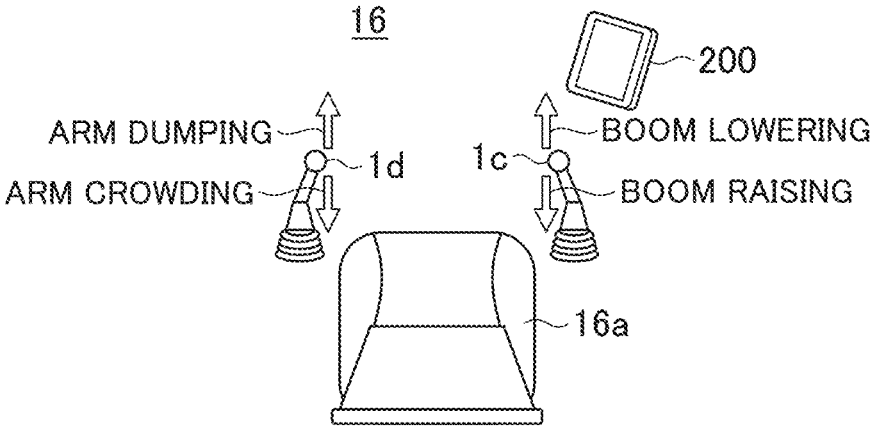
FIG. 7 is a diagram schematically depicting the inside of an operation room in which an instructing device is disposed.

FIG. 7 is a diagram schematically depicting the inside of the operation room in which the instructing device is disposed. In addition, FIG. 8 is a diagram depicting display content of the instructing device.

As depicted in FIG. 7, installed in the operation room 16 are the right operation lever device 1*c* and the left operation lever device 1*d* as operation lever devices (operation devices) respectively arranged on a right and a left in front of a sitting seat 16*a* on which the operator sits and the instructing device 200 disposed in front of the right operation lever device 1*c* on the right side of the sitting seat 16*a* so as not to obstruct a field of view when the operator views the outside of the machine. In FIG. 7, boom raising operation and boom lowering operation are assigned to the forward and rearward directions of the right operation lever device 1*c*, and arm dumping operation and arm crowding operation are assigned to the forward and rearward directions of the left operation lever device 1*d*. Incidentally, diagrammatic representation and description of another structure including the travelling right operation lever device 1*a* and the travelling left operation lever device 1*b* arranged within the operation room 16 are omitted.

Figure 8:
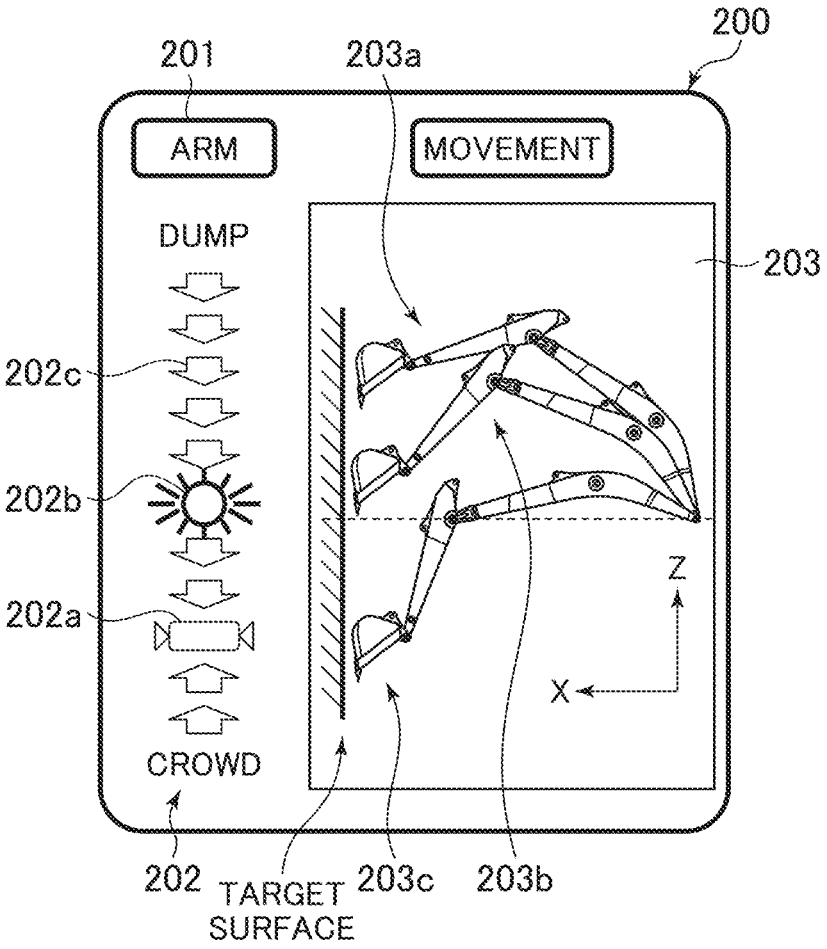
FIG. 8 is a diagram depicting display content of the instructing device.

As depicted in FIG. 8, the instructing device 200 displays: a secondary operation name display section 201 that displays the name of the secondary operation determined by the information processing device 100; a secondary operation display section 202 that indicates the recommended operation amount, the recommended operation direction, and the present operation amount of the secondary operation; and an implement arm movement display section 203 that displays present positional relation between the target surface and the implement arm 15. FIG. 8 illustrates a case where excavation work is performed while a steep wall surface facing the front of the implement arm 15 is set as the target surface. In this case, the arm 12 is the secondary operation, and "arm" is displayed as the secondary operation in the secondary operation name display section 201.

The secondary operation display section 202 has a display region extending in an upward-downward direction so as to correspond to the operation direction (that is, the forward-rearward direction) of the operation lever 1*c* corresponding to the secondary operation. The secondary operation display section 202 indicates the recommended operation amount and the recommended operation direction of the secondary operation by the positions in the upward-downward direction of figures displayed in the display region, the presence or absence of highlighting of a figure displayed in the display region, and the like.

In the secondary operation display section 202, a figure (non-operation indication) 202*b* (exemplified by a circular figure in this case) indicating a state in which the operation lever 1*c* is not operated is disposed substantially in a central portion in the upward-downward direction of the display region. In addition, in the secondary operation display section 202, a figure (recommended operation amount indication) 202*a* (exemplified by a rectangular figure with two triangles in this case) indicating the recommended operation amount and the recommended operation direction is disposed at one position in the upward-downward direction of the display region (on the lower side of the non-operation indication 202*b* in FIG. 8). In addition, in the upward-downward direction of the display region of the secondary operation display section 202, a plurality of other FIG. 202*c* (exemplified by arrow-shaped figures indicating the direction of the FIG. 202*a* in this case) are arranged so as to complement parts other than the non-operation indication (FIG. 202*b*) and the recommended operation amount indication (FIG. 202*a*).

In the secondary operation display section 202, as viewed from the non-operation indication (FIG. 202*b*), an upward direction corresponding to operation in the forward direction of the operation lever 1*d* (arm dumping operation) represents arm dumping, and a downward direction corresponding to operation in the rearward direction of the operation lever 1*d* (arm crowding operation) represents arm crowding. In addition, a distance in the upward-downward direction from the non-operation indication (FIG. 202*b*) represents an operation amount of the operation lever 1*d*. In the secondary operation display section 202, a present operation amount of the operation lever 1*d* is represented by highlighting a figure of the corresponding operation amount and operation direction more than the other figures (present operation amount indication). In addition, in the secondary operation display section 202, the recommended operation amount and the recommended operation direction of the operation lever 1*d* are represented by the display position of the recommended operation amount indication (FIG. 202*a*) as viewed from the non-operation indication (FIG. 202*b*), that is, a distance and a direction from the non-operation indication (FIG. 202*b*).

FIG. 8 illustrates a case where the recommended operation direction of the operation lever 1*d* is an arm crowding direction, and the recommended operation amount of the operation lever 1*d* is an operation amount indicated by a distance corresponding to three FIG. 202*a* from the FIG. 202*b*. In addition, a case is illustrated in which the operation lever 1*d* is not operated at present and thus the FIG. 202*b* is highlighted more than the other figures.

Incidentally, while description has been made by illustrating a case where the arm 12 is the secondary operation in FIG. 8, similar display is made also in a case where the boom 11 is the secondary operation. Specifically, when the boom 11 is the secondary operation, "boom" is displayed as the secondary operation in the secondary operation name display section 201, and the non-operation indication (FIG.

202*b*), the recommended operation amount indication (FIG. 202*a*), the plurality of other FIG. 202*c*, and the like are displayed such that the upward direction corresponding to operation in the forward direction of the operation lever 1*c* (boom lowering operation) represents boom lowering and the downward direction corresponding to operation in the rearward direction of the operation lever 1*c* (boom raising operation) represents boom raising.

The implement arm movement display section 203 displays present positional relation between the target surface and the implement arm 15. As described above, FIG. 8 illustrates a case where excavation work is performed for the target surface set along the z-axis so as to face the front of the implement arm 15. Incidentally, the implement arm movement display section 203 displays only the present positional relation between the target surface and the implement arm 15. However, FIG. 8 simultaneously depicts three positional relations between the target surface and the implement arm 15 for the purpose of description.

When the boom 11 as the primary operation is operated such that the bucket 8 (work point) moves from a state 203*a* of the implement arm 15 depicted in the implement arm movement display section 203 through a state 203*b* to a state 203*c* in the state of FIG. 8, for example, the display position of the recommended operation amount indication (FIG. 202*a*) of the arm 12 as the secondary operation moves from the position of the FIG. 202*a* through the position of the FIG. 202*b* to the position of a FIG. 202*c*.

When the display of the display region extending so as to correspond to the operation direction of the operation device corresponding to the secondary operation is thus changed so as to correspond to the recommended operation direction of the secondary operation, the operator can be instructed about the recommended operation amount and the recommended operation direction of the secondary operation. That is, because the operation direction of the operation lever 1*d* and the direction of the display content of the instructing device 200 coincide with each other, it becomes easy for the operator to intuitively understand the appropriate recommended operation amount and the appropriate recommended operation direction of the secondary operation for moving the work point (that is, the bucket 8 as a work tool) along the target surface on the basis of the information from the instructing device 200, and the operator can easily move the work point (that is, the bucket 8 as a work tool) along the target surface by operating the boom 11 as the primary operation and operating the arm 12 as the secondary operation such that the present operation amount indication (highlighted) in the secondary operation display section 202 coincides with the recommended operation amount indication (FIG. 202*a*).

Advantages of the present embodiment configured as described above will be described with reference to FIGS. 18 to 21.

FIGS. 18 to 21 are diagrams respectively illustrating various positional relations between the target surface and the implement arm. Incidentally, FIGS. 18 to 21 do not depict the machine body 9 and 10 and the hydraulic actuators 5 to 7.

Figure 18:
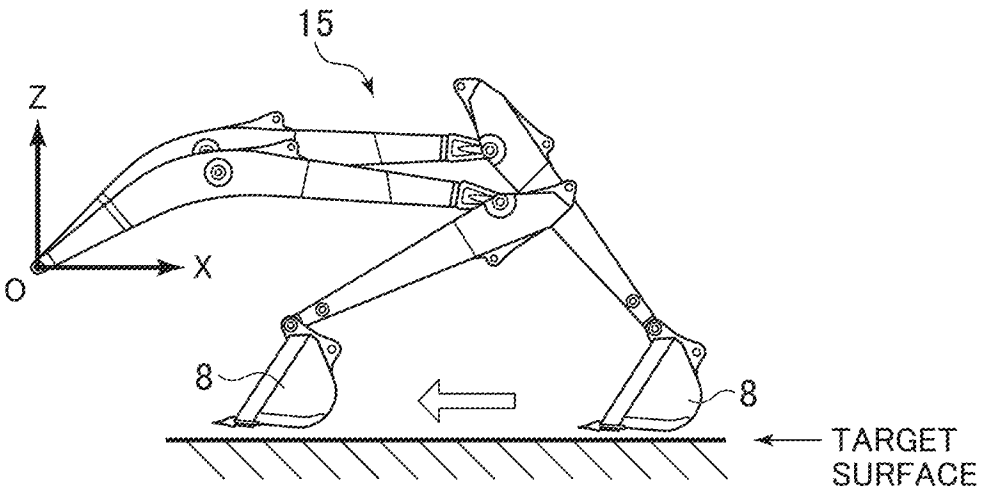
FIG. 18 is a diagram respectively illustrating various positional relations between the target surface and the implement arm.

For example, as depicted in FIG. 18, in work (so-called leveling work) of forming a landform sufficiently below the implement arm formed by the boom, the arm, the bucket, and the like of the hydraulic excavator into a horizontal target shape, the operator adjusts excavation speed in a direction parallel with the design surface by the operation of the arm and adjusts excavation height by the operation of the boom. In such a case, the operator can operate the boom appropriately by referring to information indicating a distance between the closest position of the bucket and the design surface (which information will hereinafter be referred to as distance information), as taught by the foregoing conventional technology.

Figure 19:
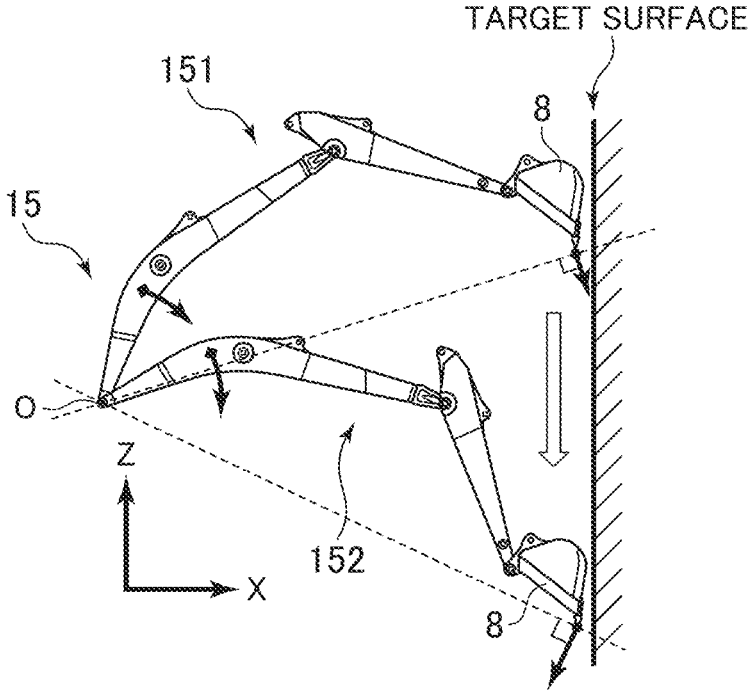
FIG. 19 is a diagram respectively illustrating the various positional relations between the target surface and the implement arm.

However, depending on the position of the design surface with respect to the implement arm, an appropriate operation by the operator may be difficult with only the distance information. Specifically, as depicted in FIG. 19, for example, in a case where a steep wall surface is excavated as the target shape, when the bucket is moved downward from above along the design surface, a moving direction (speed in the height direction of the target surface) necessary for the arm is reversed with the height of a boom pivot as a boundary. Specifically, the bucket 8 moves along the target shape when an arm crowding operation is performed while a boom lowering operation is performed in a case where the bucket 8 is present at a position higher than the origin O of the front implement coordinate system as in a posture 151 of the implement arm 15 in FIG. 19. However, the bucket 8 is separated from the target shape when an arm crowding operation is performed while a boom lowering operation is performed in a case where the bucket 8 is present at a position lower than the origin O of the front implement coordinate system as in a posture 152. That is, the direction of operating the arm by the operator is reversed. It is therefore difficult to perform an appropriate operation with only the distance information.

Figure 20:
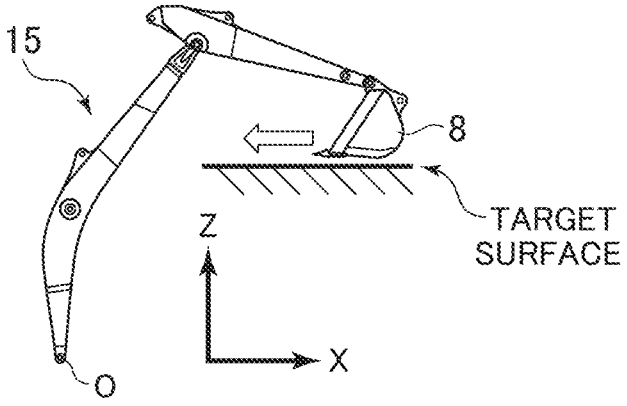
FIG. 20 is a diagram respectively illustrating the various positional relations between the target surface and the implement arm.
Figure 21:
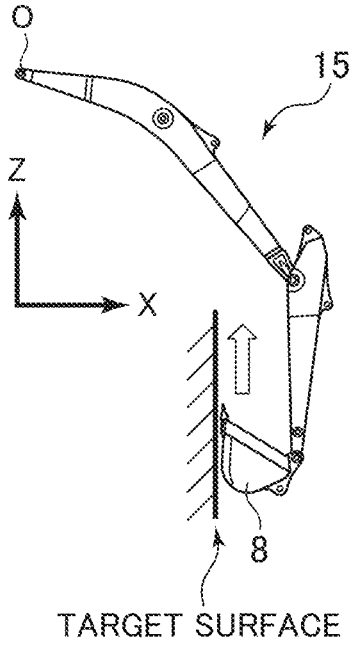
FIG. 21 is a diagram respectively illustrating the various positional relations between the target surface and the implement arm.

In addition, when leveling work in a region higher than the implement arm 15 as depicted in FIG. 20 is performed or excavation work is performed with a wall surface on a near side below as the target shape as depicted in FIG. 21, the operation of the boom for adjusting excavation height greatly changes an excavation speed necessary for the arm. That is, the operator needs to deal with changes in the speed necessary for the arm which changes are caused by the operation of the boom, and also in this case, it is difficult to obtain a sufficient excavation accuracy with only the distance information.

On the other hand, in the present embodiment, the hydraulic excavator 600 includes: the articulated implement arm 15 formed by vertically rotatably coupling the boom 11, the arm 12, and the bucket (work tool) 8 to one another, and vertically rotatably supported by the machine body (the upper swing structure 10 and the lower track structure 9) of the hydraulic excavator 600 (construction machine); the operation lever devices (operation devices) 1*c* and 1*d* configured to output operation signals for respectively operating the boom 11, the arm 12, and the bucket 8 of the implement arm 15; the inertial measurement units 13*a* to 13*c* (posture information sensor) configured to detect the posture information of each of the boom 11, the arm 12, and the bucket 8; and the information processing device 100 configured to perform information processing on the basis of the detection information of the inertial measurement units 13*a* to 13*c*, design surface information as information on the target shape of an excavation object, and the operation signals from the operation lever devices 1*c* and 1*d*. The information processing device 100 includes: the work point position computing section 110 configured to compute the relative position of a work point set on the bucket 8 with respect to the machine body 9 and 10 on the basis of the posture information; the target surface setting section 120 configured to set a target surface as a target of excavation work on the basis of the design surface information; the primary operation determining section 140 configured to determine which of operations of the boom 11 and the arm 12 is a primary operation as a main operation when the work point is moved along the target surface; and the recommended operation computing section 150 configured to compute a recommended operation amount and a recommended operation direction of a secondary operation as another operation different from the primary operation in the operations of the boom 11 and the arm 12 according to an operation amount and an operation direction of the primary operation, and display the recommended operation amount and the recommended operation direction of the secondary operation on the instructing device (display device) 200, when the excavation work is performed. An appropriate operation can therefore be notified to the operator in an easy-to-understand manner.

Second Embodiment

A second embodiment of the present invention will be described with reference to FIG. 9 and FIG. 10.

The present embodiment displays, on an instructing device, primary operation instruction information (a present operation amount and a recommended operation direction of a primary operation) in addition to secondary operation instruction information (a recommended operation amount, a recommended operation direction, and a present operation amount of a secondary operation).

Figure 9:
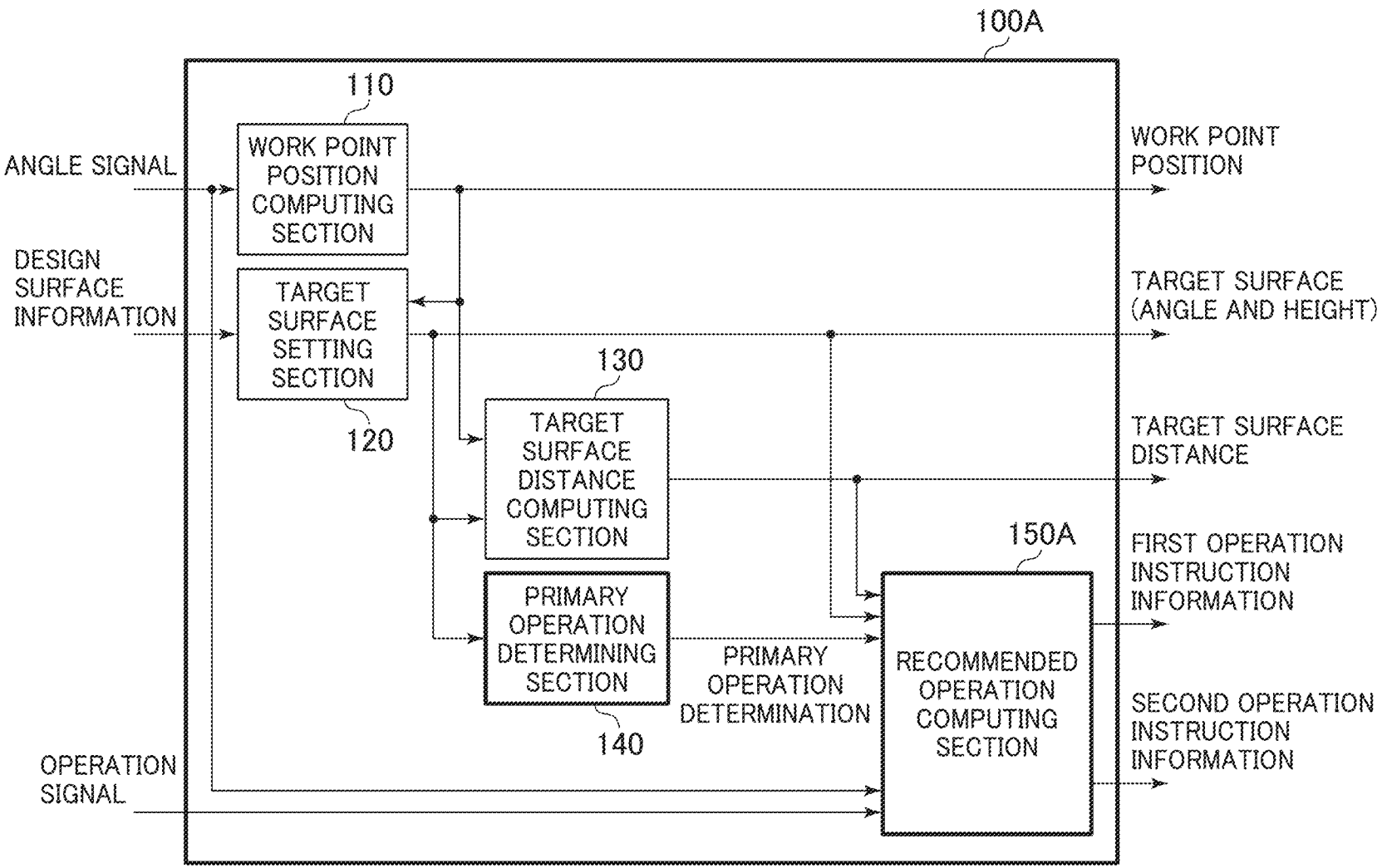
FIG. 9 is a functional block diagram depicting details of an information processing device according to a second embodiment.

FIG. 9 is a functional block diagram depicting details of an information processing device. In addition, FIG. 10 is a diagram depicting display content of an instructing device. In the figures, members similar to those of the first embodiment are identified by the same reference symbols, and description thereof will be omitted.

In FIG. 9, an information processing device 100A includes a work point position computing section 110, a target surface setting section 120, a target surface distance computing section 130, a primary operation determining section 140, and a recommended operation computing section 150A.

The recommended operation computing section 150A computes first and second operation instruction information (secondary operation instruction information or primary operation instruction information) on the basis of a target surface (target surface angle) set by the target surface setting section 120, a target surface distance computed by the target surface distance computing section 130, a determination result (primary operation determination) of the primary operation determining section 140, and operation signals from the operation lever devices (operation devices) 1*c* and 1*d*. The recommended operation computing section 150A transmits the first and second operation instruction information to the instructing device 200.

The first operation instruction information is operation instruction information about boom operation. The second operation instruction information is operation instruction information about arm operation. That is, in a case where the operation of the boom 11 is a primary operation, primary operation instruction information (a present operation amount and a recommended operation direction of the primary operation) is generated and transmitted as the first operation instruction information, and secondary operation instruction information (a recommended operation amount and a recommended operation direction of a secondary operation) is generated and transmitted as the second operation instruction information. In addition, in a case where the operation of the arm 12 is the primary operation, the secondary operation instruction information is generated and transmitted as the first operation instruction information, and the primary operation instruction information is generated and transmitted as the second operation instruction information.

Figure 10:
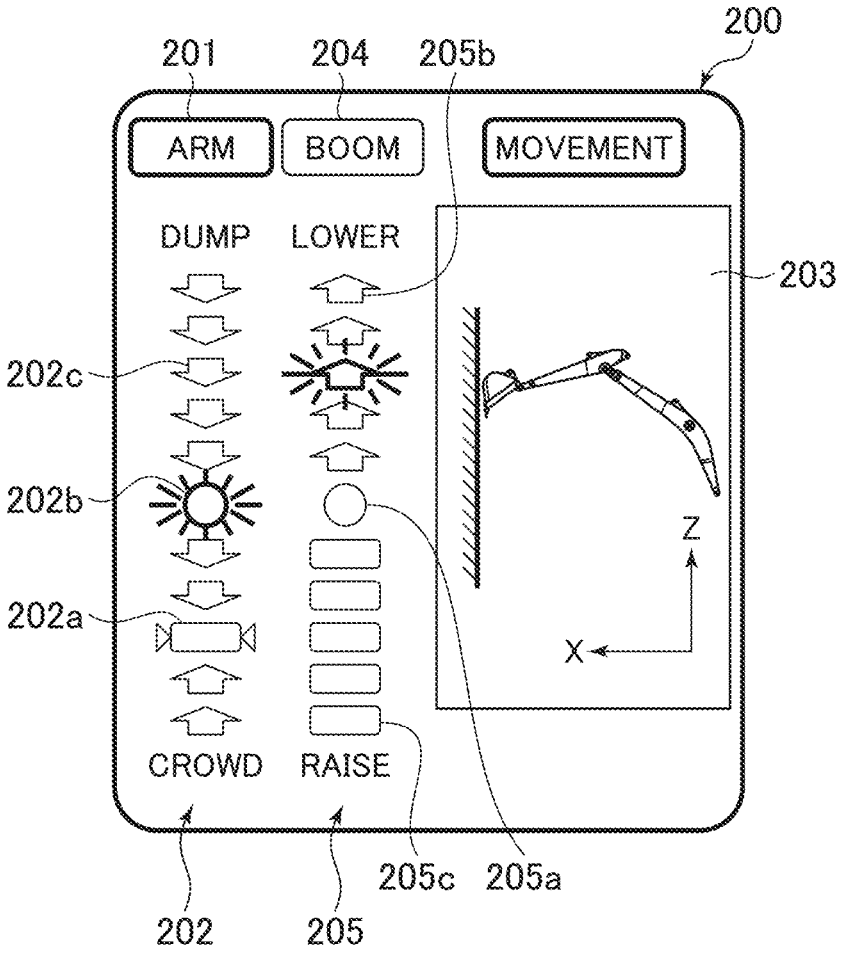
FIG. 10 is a diagram depicting display content of an instructing device according to the second embodiment.

As depicted in FIG. 10, the instructing device 200 displays: a secondary operation name display section 201 that displays the name of the secondary operation determined by the information processing device 100A; a secondary operation display section 202 that indicates the recommended operation amount, recommended operation direction, and present operation amount of the secondary operation; a primary operation name display section 204 that displays the name of the primary operation determined by the information processing device 100A; a primary operation display section 205 that indicates the present operation amount and operation direction of the primary operation; and an implement arm movement display section 203 that displays present positional relation between the target surface and the implement arm 15. FIG. 10 illustrates a case where excavation work is performed while a steep wall surface facing the front of the implement arm 15 is set as the target surface. In this case, the arm 12 is the secondary operation and the boom 11 is the primary operation. Thus, the secondary operation name display section 201 displays "arm" as the secondary operation, and the primary operation name display section 204 displays "boom" as the primary operation.

The primary operation display section 205 has a display region extending in an upward-downward direction so as to correspond to the operation direction (that is, the forward-rearward direction) of the operation lever 1*c* corresponding to the primary operation. The primary operation display section 205 indicates the present operation amount and recommended operation direction of the primary operation by the shapes of figures displayed in the display region, the presence or absence of highlighting of a figure displayed in the display region, and the like.

In the primary operation display section 205, a figure (non-operation indication) 205*a* (exemplified by a circular figure in this case) indicating a state in which the operation lever 1*c* is not operated is disposed substantially in a central portion in the upward-downward direction of the display region. In addition, in the primary operation display section 205, a plurality of figures (recommended operation direction indications) 205*b* indicating the recommended operation direction of the operation lever 1*c* (which figures are exemplified by arrow-shaped figures indicating the recommended operation direction) are arranged so as to be aligned in one of the upward direction and downward direction of the figure (non-operation indication) 205*a* (upper side of the non-operation indication 205*a* in FIG. 10). In addition, in the upward-downward direction of the display region of the primary operation display section 205, a plurality of other FIG. 205*c* (exemplified by rectangular figures in this case) are arranged so as to complement parts other than the non-operation indication (FIG. 205*a*) and the recommended operation direction indications (FIG. 205*b*).

In the primary operation display section 205, as viewed from the non-operation indication (FIG. 205*a*), an upward direction corresponding to operation in the forward direction of the operation lever 1*c* (boom lowering operation) represents boom lowering, and a downward direction corresponding to operation in the rearward direction of the operation lever 1*c* (boom raising operation) represents boom raising. In addition, a distance in the upward-downward direction from the non-operation indication (FIG. 205*a*) represents an operation amount of the operation lever 1*c*. In the primary operation display section 205, a present operation amount of the operation lever 1*c* is represented by highlighting a figure of the corresponding operation amount and operation direction more than the other figures (present operation amount indication). In addition, in the primary operation display section 205, the recommended operation direction of the operation lever 1*c* is indicated by the indication direction of the recommended operation direction indications (FIG. 205*b*) as viewed from the non-operation indication (FIG. 205*a*). FIG. 10 illustrates a case where the recommended operation direction of the operation lever 1*c* is a boom lowering direction, and the present operation amount is an operation amount represented by a distance corresponding to three FIG. 205*b* from the FIG. 205*a*.

The other structure is similar to that of the first embodiment.

The present embodiment configured as described above can also provide advantages similar to those of the first embodiment.

In addition, the instructing device 200 displays the primary operation instruction information (the present operation amount and recommended operation direction of the primary operation) in addition to the secondary operation instruction information (the recommended operation amount, recommended operation direction, and present operation amount of the secondary operation). It is therefore possible to notify the operator which operation to perform first in an easy-to-understand manner.

Third Embodiment

A third embodiment of the present invention will be described with reference to FIGS. 11 to 13.

The present embodiment has an auxiliary instructing device separately from the instructing device in the second embodiment, and separately transmits first and second operation instruction information (secondary operation instruction information or primary operation instruction information) computed by an information processing device to the instructing device and the auxiliary instructing device.

Figure 11:
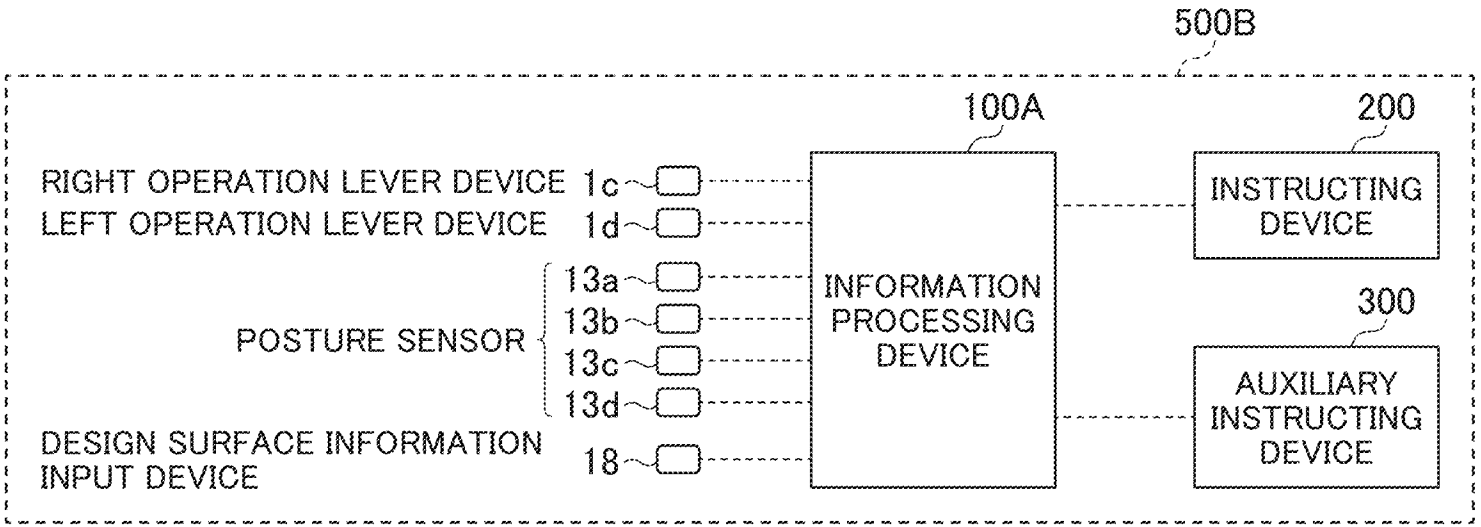
FIG. 11 is a diagram schematically depicting an operation assistance system incorporated in a hydraulic excavator according to a third embodiment.

FIG. 11 is a diagram schematically depicting an operation assistance system incorporated in a hydraulic excavator. In the figure, members similar to those of the first and second embodiments are identified by the same reference symbols, and description thereof will be omitted.

In FIG. 11, an operation assistance system 500B includes: an information processing device 100A that constitutes one section of the controller that has various functions for controlling the operation of the hydraulic excavator 600 and generates information (assistance information) for assisting in excavation work of the operator; and an instructing device (display device) 200 and an auxiliary instructing device (display device) 300 such as liquid crystal panels or the like that are disposed in the operation room 16 and instruct the operator by assistance information on excavation work or the like. Operation signals from the left and right operation lever devices 1*c* and 1*d*, detection signals (angle signals: posture information) from the respective inertial measurement units 13*a* to 13*d*, and design surface information from the design surface information input device 18 are input to the information processing device 100A. The information processing device 100A performs information processing on the basis of these inputs.

The information processing device 100A computes first operation instruction information (secondary operation instruction information or primary operation instruction information) as operation instruction information about boom operation and transmits the first operation instruction information to the instructing device 200, and computes second operation instruction information (secondary operation instruction information or primary operation instruction information) as operation instruction information about arm operation and transmits the second operation instruction information to the auxiliary instructing device 300. That is, in a case where the operation of the boom 11 is a primary operation, primary operation instruction information (a present operation amount and a recommended operation direction of the primary operation) is generated and transmitted as the first operation instruction information, and secondary operation instruction information (a recommended operation amount, a recommended operation direction, and a present operation amount of the secondary operation) is generated and transmitted as the second operation instruction information. In addition, in a case where the operation of the arm 12 is the primary operation, the secondary operation instruction information is generated and transmitted as the first operation instruction information, and the primary operation instruction information is generated and transmitted as the second operation instruction information.

Figure 12:
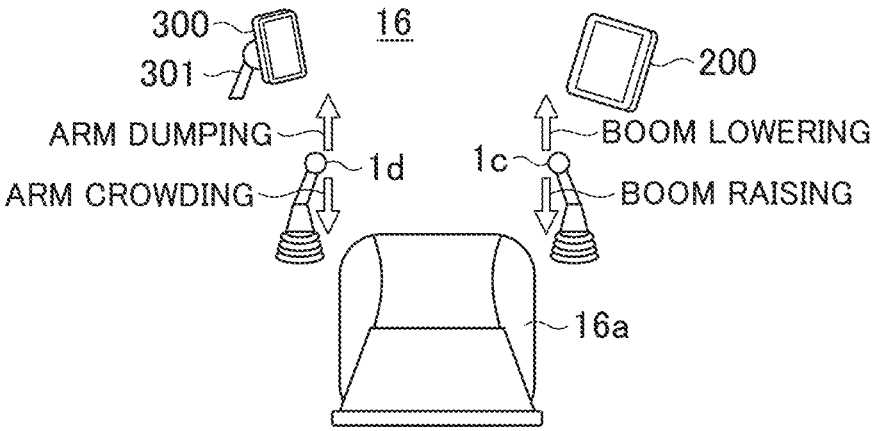
FIG. 12 is a diagram schematically depicting the inside of an operation room in which an instructing device and an auxiliary instructing device according to the third embodiment are arranged.

FIG. 12 is a diagram schematically depicting the inside of the operation room in which the instructing device and the auxiliary instructing device are arranged. In addition, FIG. 13 is a diagram depicting the display contents of the instructing device and the auxiliary instructing device side by side for comparison.

As depicted in FIG. 12, installed in the operation room 16 are a right operation lever device 1*c* and a left operation lever device 1*d* as operation lever devices (operation devices) respectively arranged on a right and a left in front of a sitting seat 16*a* on which the operator sits, the instructing device 200 disposed in front of the right operation lever device 1*c* on the right side of the sitting seat 16*a* so as not to obstruct a field of view when the operator views the outside of the machine, and the auxiliary instructing device 300 similarly disposed in front of the left operation lever device 1*d* on the left side of the sitting seat 16*a* so as not to obstruct the field of view when the operator views the outside of the machine. Incidentally, the auxiliary instructing device 300 may be a portable terminal such, for example, as a smart phone or the like, and is installed in an auxiliary instructing device holder 301.

In FIG. 12, boom raising operation and boom lowering operation are assigned to the forward and rearward directions of the right operation lever device 1*c*, and arm dumping operation and arm crowding operation are assigned to the forward and rearward directions of the left operation lever device 1*d*. Incidentally, diagrammatic representation and description of another structure including the travelling right operation lever device 1*a* and the travelling left operation lever device 1*b* arranged within the operation room 16 are omitted.

Figure 13:
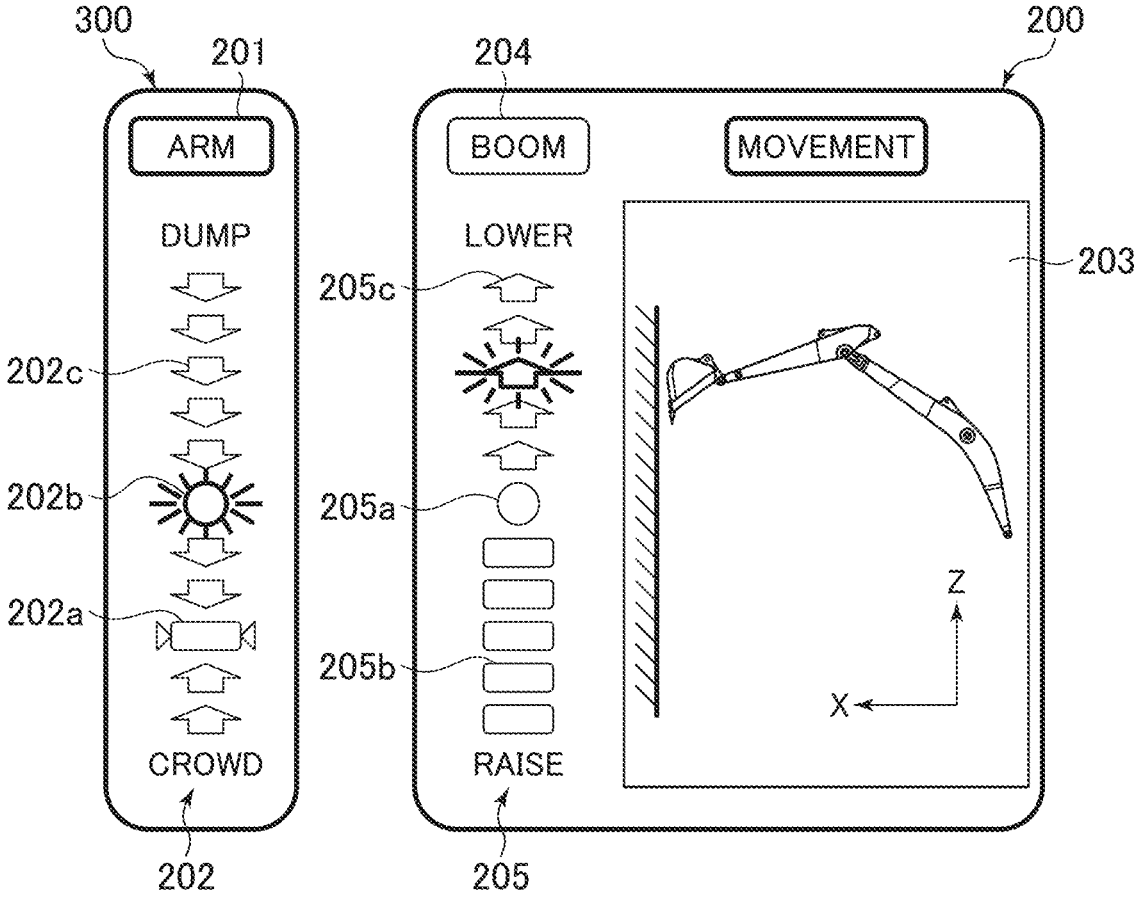
FIG. 13 is a diagram depicting display contents of the instructing device and the auxiliary instructing device according to the third embodiment side by side for comparison.

As depicted in FIG. 13, the instructing device 200 disposed in front of the right operation lever device 1*c* corresponding to boom operation makes display based on the first operation instruction information about boom operation, and the auxiliary instructing device 300 disposed in front of the left operation lever device 1*d* corresponding to arm operation makes display based on the second operation instruction information about arm operation. FIG. 13 illustrates a case where excavation work is performed while a steep wall surface facing the front of the implement arm 15 is set as the target surface. In this case, the arm 12 is the secondary operation, and the boom 11 is the primary operation. Thus, the instructing device 200 makes display based on the secondary operation instruction information generated as the first operation instruction information by the information processing device 100A, and the auxiliary instructing device 300 makes display based on the primary operation instruction information generated as the second operation instruction information.

That is, because the arm 12 is the secondary operation and the boom 11 is the primary operation, the instructing device 200 displays: a primary operation name display section 204 that displays the name of the primary operation determined by the information processing device 100A; a primary operation display section 205 that indicates the present operation amount and operation direction of the primary operation; and an implement arm movement display section 203 that displays present positional relation between the target surface and the implement arm 15. In addition, the auxiliary instructing device 300 displays: a secondary operation name display section 201 that displays the name of the secondary operation determined by the information processing device 100A; and a secondary operation display section 202 that indicates the recommended operation amount, recommended operation direction, and present operation amount of the secondary operation. The secondary operation name display section 201 of the auxiliary instructing device 300 displays "arm" as the secondary operation, and the primary operation name display section 204 of the instructing device 200 displays "boom" as the primary operation.

The other structure is similar to that of the second embodiment.

The present embodiment configured as described above can also provide advantages similar to those of the second embodiment.

In addition, the instructing device 200 and the auxiliary instructing device 300 are configured to be arranged in the vicinity of the operation lever devices 1*c* and 1*d* corresponding to the respective operation amounts to be displayed by the instructing device 200 and the auxiliary instructing device 300. It is therefore easy for the operator to understand an appropriate operation more intuitively.

Fourth Embodiment

A fourth embodiment of the present invention will be described with reference to FIG. 14 and FIG. 15.

The present embodiment makes display that deals with a case where the pattern of an operation lever is changed in the third embodiment.

Figure 14:
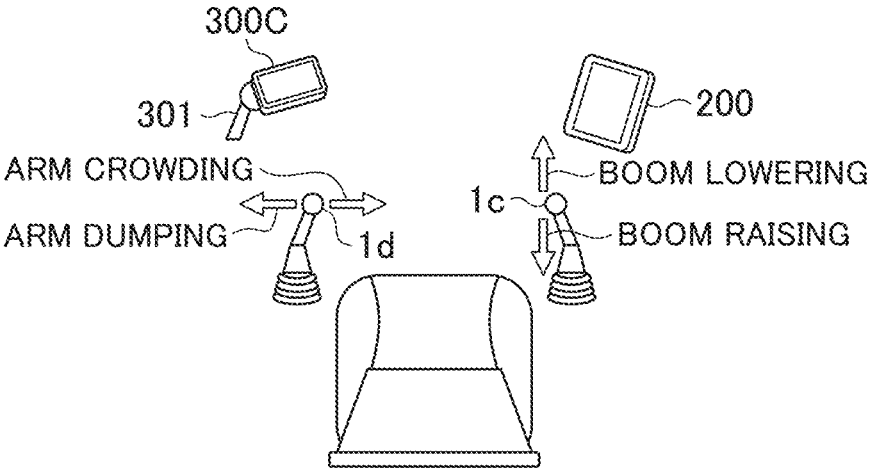
FIG. 14 is a diagram schematically depicting the inside of an operation room in which an instructing device and an auxiliary instructing device according to a fourth embodiment are arranged.

FIG. 14 is a diagram schematically depicting the inside of an operation room in which an instructing device and an auxiliary instructing device are arranged. In addition, FIG. 15 is a diagram depicting the display content of the auxiliary instructing device. In the figures, members similar to those of the first to third embodiments are identified by the same reference symbols, and description thereof will be omitted.

As depicted in FIG. 14, installed in the operation room 16 are a right operation lever device 1*c* and a left operation lever device 1*d* as operation lever devices (operation devices) respectively arranged on a right and a left in front of a sitting seat 16*a* on which the operator sits, an instructing device 200 disposed in front of the right operation lever device 1*c* on the right side of the sitting seat 16*a* so as not to obstruct a field of view when the operator views the outside of the machine, and an auxiliary instructing device 300C similarly disposed in front of the left operation lever device 1*d* on the left side of the sitting seat 16*a* so as not to obstruct the field of view when the operator views the outside of the machine.

In FIG. 14, boom raising operation and boom lowering operation are assigned to the forward and rearward directions of the right operation lever device 1*c*, and arm dumping operation and arm crowding operation are assigned to the left and right directions of the left operation lever device 1*d*. Incidentally, diagrammatic representation and description of another structure including the travelling right operation lever device 1*a* and the travelling left operation lever device 1*b* arranged within the operation room 16 are omitted.

Figure 15:
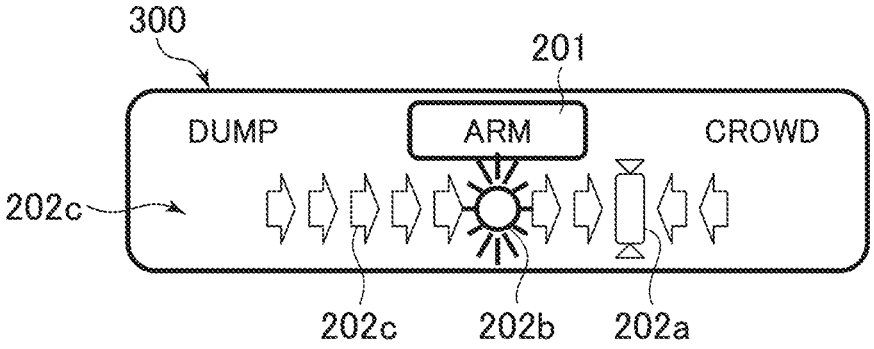
FIG. 15 is a diagram depicting the display content of the auxiliary instructing device according to the fourth embodiment.

As depicted in FIG. 15, the auxiliary instructing device 300C disposed in front of the left operation lever device 1*d* corresponding to arm operation makes display based on second operation instruction information about arm operation. FIG. 15 illustrates a case where the arm 12 is a secondary operation, and the auxiliary instructing device 300C makes display based on primary operation instruction information generated as the second operation instruction information. In this case, the auxiliary instructing device 300C displays a secondary operation name display section 201 that displays the name of the secondary operation determined by the information processing device 100A and a secondary operation display section 202C that indicates the recommended operation amount, recommended operation direction, and present operation amount of the secondary operation. The secondary operation name display section 201 of the auxiliary instructing device 300C displays "arm" as the secondary operation.

The secondary operation display section 202C has a display region extending in a left-right direction so as to correspond to the operation direction (that is, the left-right direction) of the operation lever 1*d* corresponding to the secondary operation. The secondary operation display section 202C indicates the present operation amount and recommended operation direction of the secondary operation by the shapes of figures displayed in the display region, the presence or absence of highlighting of a figure displayed in the display region, and the like.

In the secondary operation display section 202C, a figure (non-operation indication) 202*b* (exemplified by a circular figure in this case) indicating a state in which the operation lever 1*d* is not operated is disposed in substantially a central portion in the left-right direction of the display region. In addition, in the secondary operation display section 202C, a figure (recommended operation amount indication) 202*a* (exemplified by a rectangular figure with two triangles in this case) indicating the recommended operation amount and the recommended operation direction is disposed at one position in the left-right direction of the display region (on the right side of the non-operation indication 202*b* in FIG. 15). In addition, in the left-right direction of the display region of the secondary operation display section 202C, a plurality of other FIG. 202*c* (exemplified by arrow-shaped figures indicating the direction of the FIG. 202*a* in this case) are arranged so as to complement parts other than the non-operation indication (FIG. 202*b*) and the recommended operation amount indication (FIG. 202*a*).

The other structure is similar to that of the third embodiment.

The present embodiment configured as described above can also provide advantages similar to those of the third embodiment.

In addition, even when the pattern of the operation lever is changed, the auxiliary instructing device 300 (or the instructing device 200) corresponding to the operation lever is installed so as to be oriented in a direction (the horizontal direction, for example) coinciding with the pattern of the operation lever after the change. Thus, the direction of the operation lever and the direction of the display content of the auxiliary instructing device 300 (or the instructing device 200) coincide with each other. It therefore becomes easy for the operator to understand an appropriate operation more intuitively.

Fifth Embodiment

A fifth embodiment of the present invention will be described with reference to FIG. 16 and FIG. 17.

The present embodiment predictively computes and displays the recommended operation amount and the recommended operation direction of the secondary operation, the recommended operation amount and the recommended operation direction being computed and displayed on the basis of the operation amount and operation direction of the primary operation in the second embodiment, even when no lever operation is performed by the operator.

Figure 16:
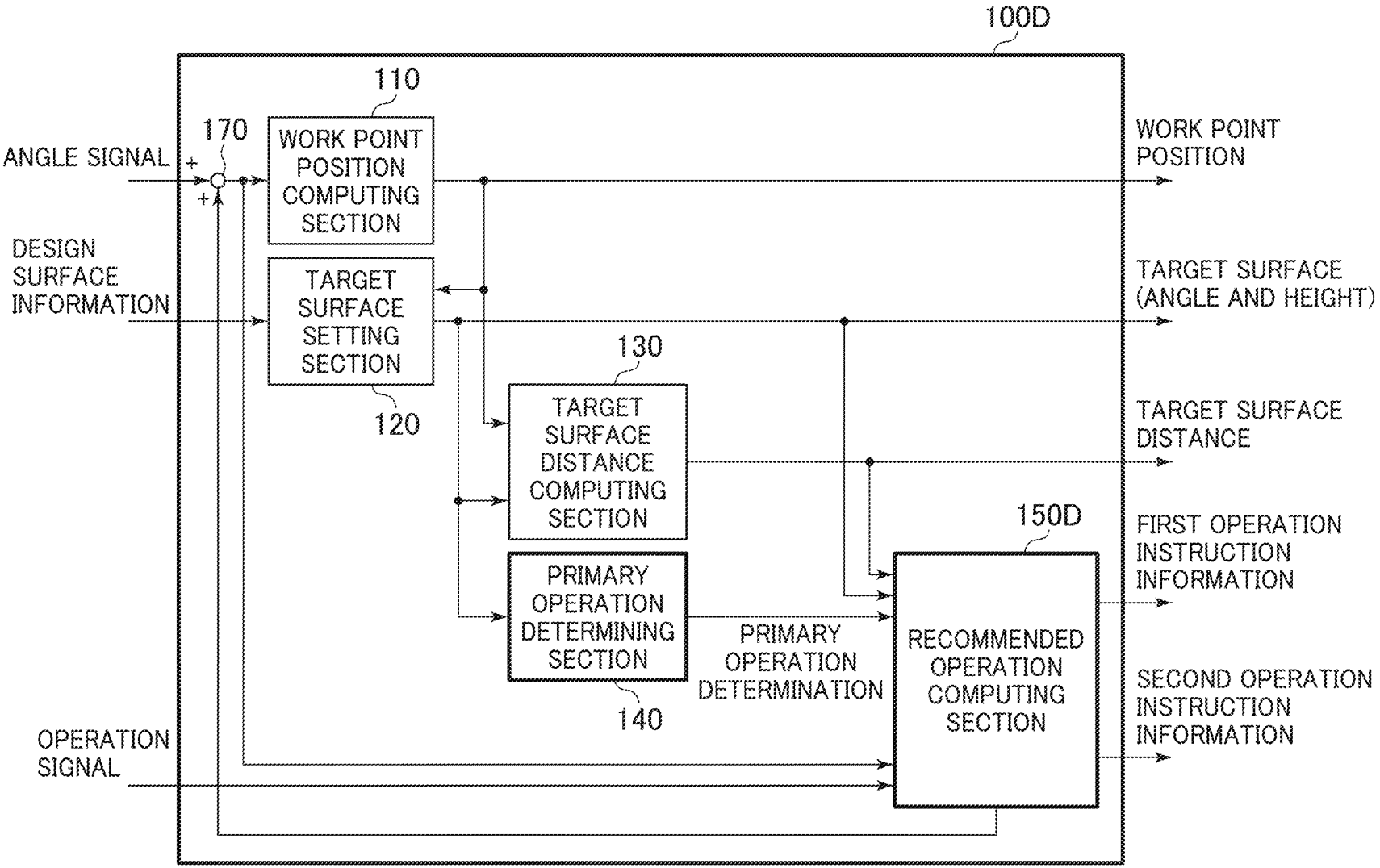
FIG. 16 is a functional block diagram depicting details of an information processing device according to a fifth embodiment.

FIG. 16 is a functional block diagram depicting details of an information processing device. In the figure, members similar to those of the first and second embodiments are identified by the same reference symbols, and description thereof will be omitted.

In FIG. 16, an information processing device 100D includes a work point position computing section 110, a target surface setting section 120, a target surface distance computing section 130, a primary operation determining section 140, a recommended operation computing section 150D, and an addition operator 170.

The recommended operation computing section 150D computes first and second operation instruction information (secondary operation instruction information or primary operation instruction information) on the basis of a target surface (target surface angle) set by the target surface setting section 120, a target surface distance computed by the target surface distance computing section 130, a determination result (primary operation determination) of the primary operation determining section 140, and operation signals from the operation lever devices (operation devices) 1*c* and 1*d*. The recommended operation computing section 150D transmits the first and second operation instruction information to the instructing device 200. In addition, when there is no operation signals from the operation lever devices (operation devices) 1*c* and 1*d*, the recommended operation computing section 150D computes an angular speed (pseudo primary operation angular speed) of a driven member in a primary operation in a pseudo manner, and generates an angle signal (pseudo posture signal) corresponding to the pseudo primary operation angular speed in a pseudo manner and outputs the angle signal (pseudo posture signal) to the addition operator 170. The recommended operation computing section 150D obtains a computation result of the target surface distance computing section 130 in a pseudo manner by obtaining a computation result of the work point position computing section 110 in a pseudo manner on the basis of the pseudo posture signal, and consequently obtains a secondary operation target angular speed in a pseudo manner. Incidentally, the pseudo posture signal is obtained by integrating each of the pseudo primary operation angular speed and the secondary operation target angular speed.

The addition operator 170 is provided to a part where angle signals (posture signals) are input to the information processing device 100D. The addition operator 170 adds the angle signal (pseudo posture information) generated in a pseudo manner by the recommended operation computing section 150D to the angle signals (posture signals) input from the inertial measurement units 13*a* to 13*d* to the information processing device 100D. The addition operator 170 outputs a result of the addition to the work point position computing section 110 and the recommended operation computing section 150D.

Figure 17:
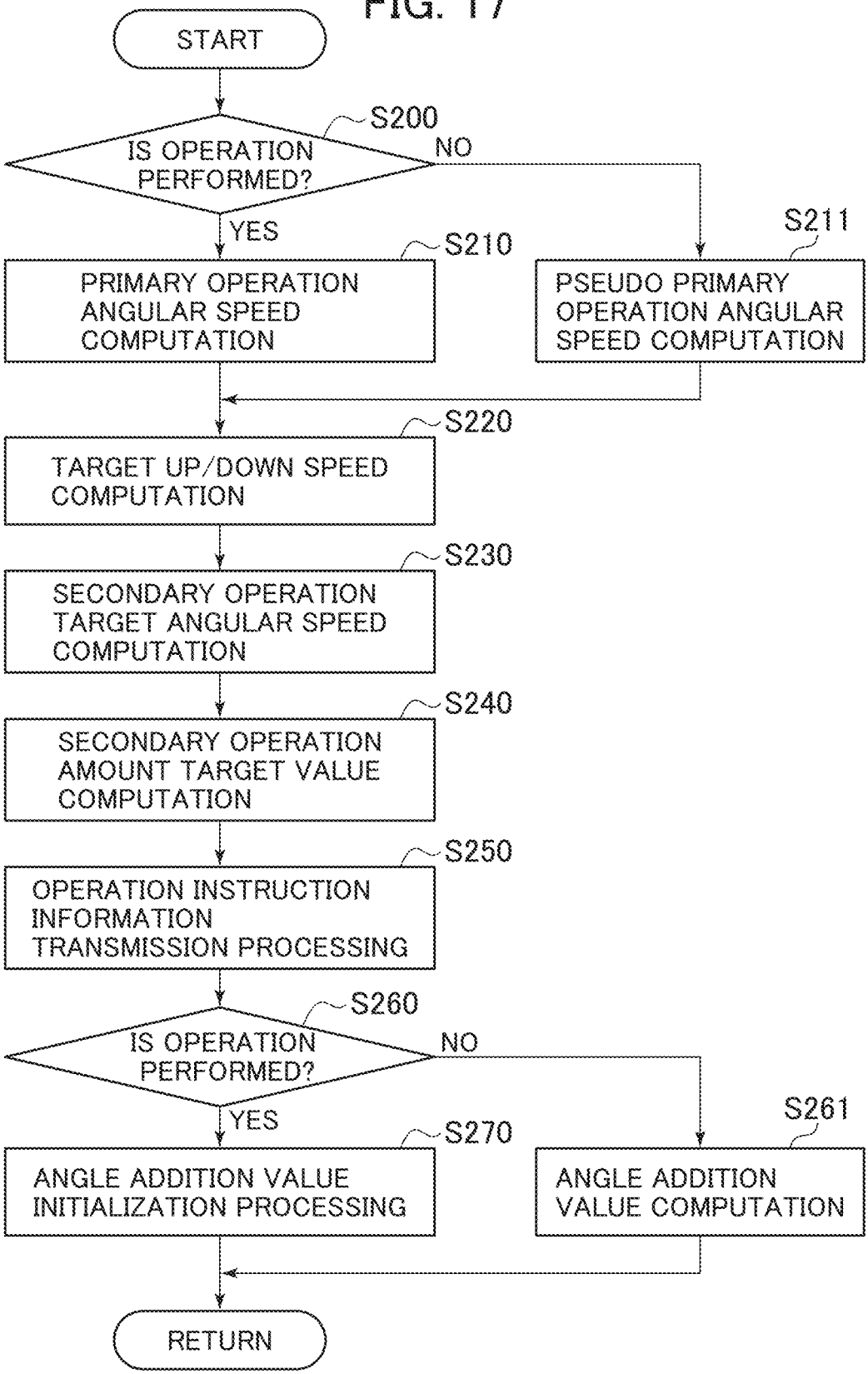
FIG. 17 is a flowchart depicting processing of computing secondary operation instruction information by a recommended operation computing section according to the fifth embodiment.

FIG. 17 is a flowchart depicting processing of computing the secondary operation instruction information by the recommended operation computing section.

In FIG. 17, the recommended operation computing section 150D first determines whether the operation lever devices 1*c* and 1*d* are operated on the basis of the operation signals (step S200). When a result of the determination is YES, the recommended operation computing section 150D computes the angular speed of the driven member in the primary operation (primary operation angular speed) on the basis of the operation signal for the driven member (the boom 11 or the arm 12) of the implement arm 15 which driven member is determined as the driven member in the primary operation (step S210). In addition, when the result of the determination in step S200 is NO, that is, when it is determined that none of the operation lever devices 1*c* and 1*d* are operated, the angular speed (pseudo primary operation angular speed) of the driven member in the primary operation is computed in a pseudo manner (step S211).

After the primary operation angular speed or the pseudo primary operation angular speed is computed in step S210 or S211, a target up/down speed as a target speed in a direction perpendicular to the target surface is next computed on the basis of the target surface distance (step S220). Next, a secondary operation target angular speed is computed according to the angle signal on the basis of the primary operation angular speed or the pseudo primary operation angular speed and the target up/down speed (step S230). Next, a secondary operation amount target value (recommended operation amount) as a recommended value of the secondary operation and a recommended operation direction are computed on the basis of the secondary operation target angular speed (step S240). Next, secondary operation instruction information is generated on the basis of the primary operation determination, the operation signal, and the secondary operation amount target value, and transmitted to the instructing device 200 together with the primary operation instruction information (step S250).

Here, whether the operation levers 1*c* and 1*d* are operated is determined again on the basis of the operation signals (step S260). When a result of the determination is NO, angle addition value computation processing is performed which generates the angle signal (pseudo posture signal) corresponding to the pseudo primary operation angular speed in a pseudo manner and inputs the angle signal to the information processing device 100D via the addition operator 170 (step S261). The processing is then ended. In addition, when the result of the determination in step S260 is YES, angle addition value initializing processing is performed which resets the angle signal (pseudo posture signal) output to the addition operator 170 to 0 (zero) (step S270). The processing is then ended.

The other structure is similar to that of the second embodiment.

The present embodiment configured as described above can also provide advantages similar to those of the second embodiment.

In addition, when no operation is performed by the operator, a target operation and/or a recommended operation is displayed on the instructing device 200 before a start of operation of the operator, so that it becomes easy for the operator to understand an appropriate operation.

Features of each of the foregoing embodiments will next be described.

(1) In the foregoing embodiments, the construction machine includes: the articulated implement arm 15 formed by vertically rotatably coupling the boom 11, the arm 12, and the work tool (the bucket 8, for example) to one another, and vertically rotatably supported by the machine body (the upper swing structure 10 and the lower track structure 9, for example) of the construction machine (the hydraulic excavator 600, for example); operation devices (the operation levers 1*c* and 1*d*, for example) configured to output operation signals for respectively operating the boom 11, the arm 12, and the work tool of the implement arm 15; the posture information sensor (the inertial measurement units 13*a* to 13*c*, for example) configured to detect the posture information of each of the boom 11, the arm 12, and the bucket 8; and the information processing device 100 configured to perform information processing on the basis of the detection information of the posture information sensor, design surface information as information on the target shape of an excavation object, and the operation signals from the operation devices. The information processing device 100 includes: the work point position computing section 110 configured to compute the relative position of a work point set on the work tool with respect to the machine body on the basis of the posture information; the target surface setting section 120 configured to set a target surface as a target of excavation work on the basis of the design surface information; the primary operation determining section 140 configured to determine which of operations of the boom 11 and the arm 12 is a primary operation as a main operation when the work point is moved along the target surface; and the recommended operation computing section 150 configured to compute a recommended operation amount and a recommended operation direction of a secondary operation as another operation different from the primary operation in the operations of the boom 11 and the arm 12 according to an operation amount and an operation direction of the primary operation, and display the recommended operation amount and the recommended operation direction of the secondary operation on the instructing device (the instructing device 200, for example), when the excavation work is performed.

With such a structure, it is possible to notify the operator of an appropriate operation in an easy-to-understand manner.

(2) In addition, in the foregoing embodiments, in the construction machine of (1), the recommended operation computing section displays the operation amount and the operation direction of the primary operation on the instructing device simultaneously with the recommended operation amount and the recommended operation direction of the secondary operation.

Thus, the primary operation instruction information (the present operation amount and the recommended operation direction of the primary operation) is displayed on the instructing device in addition to the secondary operation instruction information (the recommended operation amount, the recommended operation direction, and the present operation amount of the secondary operation). It is therefore possible to notify the operator which operation to perform first in an easy-to-understand manner.

(3) In addition, in the foregoing embodiment, in the construction machine of (2), the instructing device changes display of a display region, the display region extending so as to correspond to an operation direction of an operation device corresponding to the primary operation, so as to correspond to the operation direction of the primary operation.

Thus, the operation direction of the operation lever and the direction of the display content of the instructing device coincide with each other. It therefore becomes easy for the operator to understand the operation amount and operation direction of the primary operation intuitively on the basis of information from the instructing device.

(4) In addition, in the foregoing embodiment, in the construction machine of (1), the instructing device changes display of a display region, the display region extending so as to correspond to an operation direction of an operation device corresponding to the secondary operation, so as to correspond to the recommended operation direction of the secondary operation.

Thus, the operation direction of the operation lever and the direction of the display content of the instructing device coincide with each other. It therefore becomes easy for the operator to intuitively understand the appropriate recommended operation amount and the appropriate recommended operation direction of the secondary operation for moving the work point (that is, the bucket 8 as the work tool) along the target surface on the basis of information from the instructing device.

(5) In addition, in the foregoing embodiment, in the construction machine of (1), when the operation devices are not operated, the recommended operation computing section sets a pseudo operation amount and a pseudo operation direction assuming the operation amount and the operation direction of the primary operation assumed in the excavation work corresponding to the target surface, computes the recommended operation amount and the recommended operation direction of the secondary operation as the other operation different from the primary operation in the operations of the boom and the arm according to the pseudo operation amount and the pseudo operation direction of the primary operation, and displays the recommended operation amount and the recommended operation direction of the secondary operation on the instructing device.

Thus, when no operation is performed by the operator, a target operation and/or a recommended operation is displayed on the instructing device before a start of operation of the operator, so that it becomes easy for the operator to understand an appropriate operation.

<Supplementary Notes>

It is to be noted that while the foregoing embodiments have been described by taking as an example a typical hydraulic excavator that drives a hydraulic pump by a prime mover such as an engine or the like, it is needless to say that the present invention is applicable also to a hybrid hydraulic excavator that drives a hydraulic pump by an engine and a motor, an electric hydraulic excavator that drives a hydraulic pump by only a motor, and the like.

In addition, the present invention is not limited to the foregoing embodiments, but includes various modifications and combinations within a scope not departing from the spirit of the present invention. In addition, the present invention is not limited to those including all of the structures described in the foregoing embodiments, but also includes those from which a part of the structures are omitted. In addition, a part or the whole of each of the structures, the functions, and the like described above may be implemented by, for example, being designed in an integrated circuit or the like. In addition, each of the structures, the functions, and the like described above may be implemented by software such that a processor interprets and executes a program that implements each function.

REFERENCE SIGNS LIST

1 front implement (front work implement)
1*a* travelling right operation lever device
1*b* travelling left operation lever device
1*c* right operation lever device (operation device)
1*d* left operation lever device (operation device)
2 hydraulic pump device
3*b* travelling hydraulic motor
4 swing hydraulic motor
5 boom cylinder
6 arm cylinder
7 bucket cylinder
8 bucket (work tool)
8*a* bucket link
9 lower track structure
10 upper swing structure
11 boom
12 arm
13*a*, 13*b*, 13*c*, 13*d* inertial measurement unit (IMU)
14 engine
15 front implement (front work implement)
16 operation room
16*a* sitting seat
17*a*, 17*b*, 17*c* pressure sensor
18 design surface information input device
20 control valve
51 excavation impossible regions
52 excavation impossible regions
53, 54 boom primary operation region
55 arm primary operation region
100, 100A, 100*d* information processing device
110 work point position computing section
120 target surface setting section
130 target surface distance computing section
140 primary operation determining section
150, 150A, 150D recommended operation computing section
170 addition operator
200 instructing device (display device)
201 secondary operation name display section
202, 202C secondary operation display section
202*a* recommended operation amount indication
202*b* non-operation indication
202*c* FIG.
203 implement arm movement display section
204 primary operation name display section
205 primary operation display section
205*a* non-operation indication
205*b* recommended operation direction indications
205*c* FIG.
300 auxiliary instructing device (display device)
301 auxiliary instructing device holder
500, 500B operation assistance system
600 hydraulic excavator

The invention claimed is:

1. A construction machine comprising:

an articulated front work implement formed by vertically rotatably coupling a boom, an arm, and a work tool to one another, and vertically rotatably supported by a machine body of the construction machine;

operation devices configured to output operation signals for respectively operating the boom, the arm, and the work tool of the front work implement;

a posture information sensor configured to detect posture information of each of the boom, the arm, and the work tool; and an information processing device configured to perform information processing on a basis of the posture information detected by the posture information sensor, design surface information as information on a target shape of an excavation object, and the operation signals from the operation devices;

the information processing device configured to:

compute a relative position of a work point set on the work tool with respect to the machine body on a basis of the posture information, set a target surface as a target of excavation work on a basis of the design surface information, determine which of the boom and the arm is a primary operation as a main operation based on a target surface angle and a target surface height of the target surface when the work point is moved along the target surface, wherein when the boom and the arm are driven at the same time, set the primary operation to be the operation with a higher operating speed and a higher operating amount, and compute a recommended operation amount and a recommended operation direction of a secondary operation for moving the work point along the target surface by the secondary operation as another operation different from the primary operation determined by the operations of the boom and the arm according to an operation amount and an operation direction of the primary operation when the excavation work is performed by driving the boom and the arm at the same time, and display the current operation amount of the secondary operation, the current operation direction of the secondary operation, the recommended operation amount and the recommended operation direction of the secondary operation on an instructing device together with the current positional relationship between the target surface and the front work implement.

2. The construction machine according to claim 1, wherein the information processing device is further configured to:

display the operation amount and the operation direction of the primary operation on the instructing device simultaneously with the recommended operation amount and the recommended operation direction of the secondary operation.

3. The construction machine according to claim 2, wherein the instructing device changes display of a display region, the display region extending so as to correspond to an operation direction of an operation device corresponding to the primary operation, so as to correspond to the operation direction of the primary operation.

4. The construction machine according to claim 1, wherein the instructing device changes display of a display region, the display region extending so as to correspond to an operation direction of an operation device corresponding to the secondary operation, so as to correspond to the recommended operation direction of the secondary operation.

5. The construction machine according to claim 1, wherein when the operation devices are not operated, the information processing device is further configured to set a pseudo operation amount and a pseudo operation direction assuming the operation amount and the operation direction of the primary operation assumed in the excavation work corresponding to the target surface, compute the recommended operation amount and the recommended operation direction of the secondary operation different from the primary operation in the operations of the boom and the arm according to the pseudo operation amount and the pseudo operation direction of the primary operation, and display the recommended operation amount and the recommended operation direction of the secondary operation on the instructing device.

* * * * *